US007015886B2

(12) United States Patent
Matsuyama

(10) Patent No.: US 7,015,886 B2
(45) Date of Patent: Mar. 21, 2006

(54) SCANNING LINE DRIVER CIRCUITS, ELECTROOPTIC APPARATUSES, ELECTRONIC APPARATUSES AND SEMICONDUCTOR DEVICES

(75) Inventor: Shigoru Matsuyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 377 days.

(21) Appl. No.: 10/205,583

(22) Filed: Jul. 24, 2002

(65) Prior Publication Data

US 2003/0020702 A1 Jan. 30, 2003

(30) Foreign Application Priority Data

Jul. 27, 2001 (JP) ..... 2001-227799

(51) Int. Cl.
*G09G 3/36* (2006.01)

(52) U.S. Cl. ..... 345/87; 345/88; 345/89; 345/90; 345/101; 345/103

(58) Field of Classification Search ..... 345/63, 345/67, 204, 90–103, 208, 87–89; 235/462, 235/467; 382/294; 348/169
See application file for complete search history.

(56) References Cited

U.S. PATENT DOCUMENTS

| | | | | |
|---|---|---|---|---|
| 5,723,852 | A * | 3/1998 | Rando et al. | 235/462.4 |
| 5,867,139 | A * | 2/1999 | Tanaka et al. | 345/92 |
| 6,460,767 | B1 * | 10/2002 | Knowles et al. | 235/462.37 |
| 6,563,610 | B1 * | 5/2003 | Wakui | 358/487 |
| 6,624,801 | B1 * | 9/2003 | Moriyama | 345/100 |
| 6,803,886 | B1 * | 10/2004 | Kondo et al. | 345/8 |
| 2001/0005189 | A1 * | 6/2001 | Nunomura | 345/60 |
| 2001/0017611 | A1 * | 8/2001 | Moriyama | 345/100 |
| 2001/0045924 | A1 * | 11/2001 | Huang | 345/63 |
| 2003/0020702 | A1 * | 1/2003 | Matsuyama | 345/204 |
| 2003/0156086 | A1 * | 8/2003 | Maeda et al. | 345/89 |
| 2004/0135761 | A1 * | 7/2004 | Cheng et al. | 345/100 |

FOREIGN PATENT DOCUMENTS

| | | |
|---|---|---|
| JP | 04-116588 | 4/1992 |
| JP | 09-269511 | 10/1997 |
| JP | 2001-092424 | 4/2001 |

* cited by examiner

*Primary Examiner*—Vijay Shankar
*Assistant Examiner*—Prabodh Dharia
(74) *Attorney, Agent, or Firm*—Hogan & Hartson, L.L.P.

(57) ABSTRACT

A scanning line driver circuit is provided that can narrow intervals of its scanning lines to values exceeding the limitation value of its output pitch without harming the versatility of a data line driver circuit. A first scanning control signal generation circuit can generate a first scanning control signal for scan-driving a first group of scanning lines, and a second scanning control signal generation circuit can generate a second scanning control signal for scan-driving a second group of scanning lines. A selection output circuit can select and output one of the first scanning control signal and the second scanning control signal as a scanning control signal based on positional information inputted from a data line driver circuit. A scanning driving circuit can supply scanning signals for scan-driving to the respective scanning lines based on the scanning control signal that has been selected and outputted.

28 Claims, 14 Drawing Sheets

SCANNING LINE DRIVER CIRCUITS, ELECTROOPTIC APPARATUSES, ELECTRONIC APPARATUSES AND SEMICONDUCTOR DEVICES

BACKGROUND OF THE INVENTION

The present invention relates to scanning line driver circuits, and electrooptic apparatuses, electronic apparatuses and semiconductor devices using the same.

Electrooptic apparatuses such as liquid crystal panels are widely used at display sections of electronic apparatuses, such as, watches, mobile phones, personal digital assistants (PDAs) and the like. In recent years, while the amount of information to be displayed has increased because of the increased data processing capability, there has been an increasing demand for electronic apparatuses exhibiting reduced size and higher picture resolution.

Electrooptic apparatuses such as liquid crystal panels thus need to increase the number of pixels per unit area. This is typically accomplished by reducing the size of each pixel (dot). This can be accomplished by narrowing gaps of data lines and gaps of scanning lines that define the pixels. Driver circuits typically output a driving signal to each of the lines. Data line driver circuits supply data signals based on image data to data lines.

Attempts have been made to narrow the gaps of data lines and the gaps of scanning lines. However, due to the problems relating to mounting efficiency and the like, the gap of these lines cannot be narrowed to values beyond the limit of the output pitch of a driver circuit. Because data line driver circuits are driven for display according to a given driving method, data line driver circuits require a complex control circuit and also must be able to accommodate for changes in the number of display colors. Data line driver circuits are relatively more expensive than scanning line driver circuits Accordingly, there is a need for data line driver circuits that are more versatile, yet that do not require changes to the driving methods and/or changes in the value of the output pitch.

SUMMARY OF THE PREFERRED EMBODIMENTS

Aspects of the present invention provide scanning line driver circuits adapted to drive a first group of scanning lines or a second group of scanning lines of an electrooptic apparatus in which pixels are defined by a plurality of data lines and at least one of the first group of scanning lines or the second group of scanning lines mutually traversing one another. The scanning line driver circuit includes a circuit adapted to generate a scanning control signal for driving at least one of the first group of scanning lines and the second group of scanning lines from a given display control signal provided from a data line driver circuit that data-drives the plurality of data lines based on given positional information. The scanning line driver circuit also includes a driver circuit that outputs a scanning signal based on the scanning control signal.

Aspects of the present invention provide scanning line driver circuits adapted to drive a first group of scanning lines or a second group of scanning lines of an electrooptic apparatus in which pixels are defined by a plurality of data lines and at least one of the first group of scanning lines or the second group of scanning lines mutually traversing one another. The scanning line driver circuits can include a first circuit that generates a first scanning control signal, a second circuit that generates a second scanning control signal; a selection output circuit; and a driver circuit. The first circuit drives the first group of scanning lines based on a given display control signal provided from a data line driver circuit that data-drives the plurality of data lines. The second circuit drives the second group of scanning lines based on the given display control signal. The selection output circuit selects and outputs one of the first scanning control signal and the second scanning control signal. The driver circuit outputs a scanning signal based on the scanning control signal selected and outputted.

Scanning line driver circuits such as those mentioned above can be implemented in, for example electrooptic apparatuses, an electronic apparatuses, and/or a semiconductor devices.

BRIEF DESCRIPTION OF DRAWINGS

The following discussion may be best understood with reference to the various views of the drawings, described in summary below, which form a part of this disclosure.

DETAILED DESCRIPTION OF THE PREFERRED EMBODIMENTS

Figure 1:
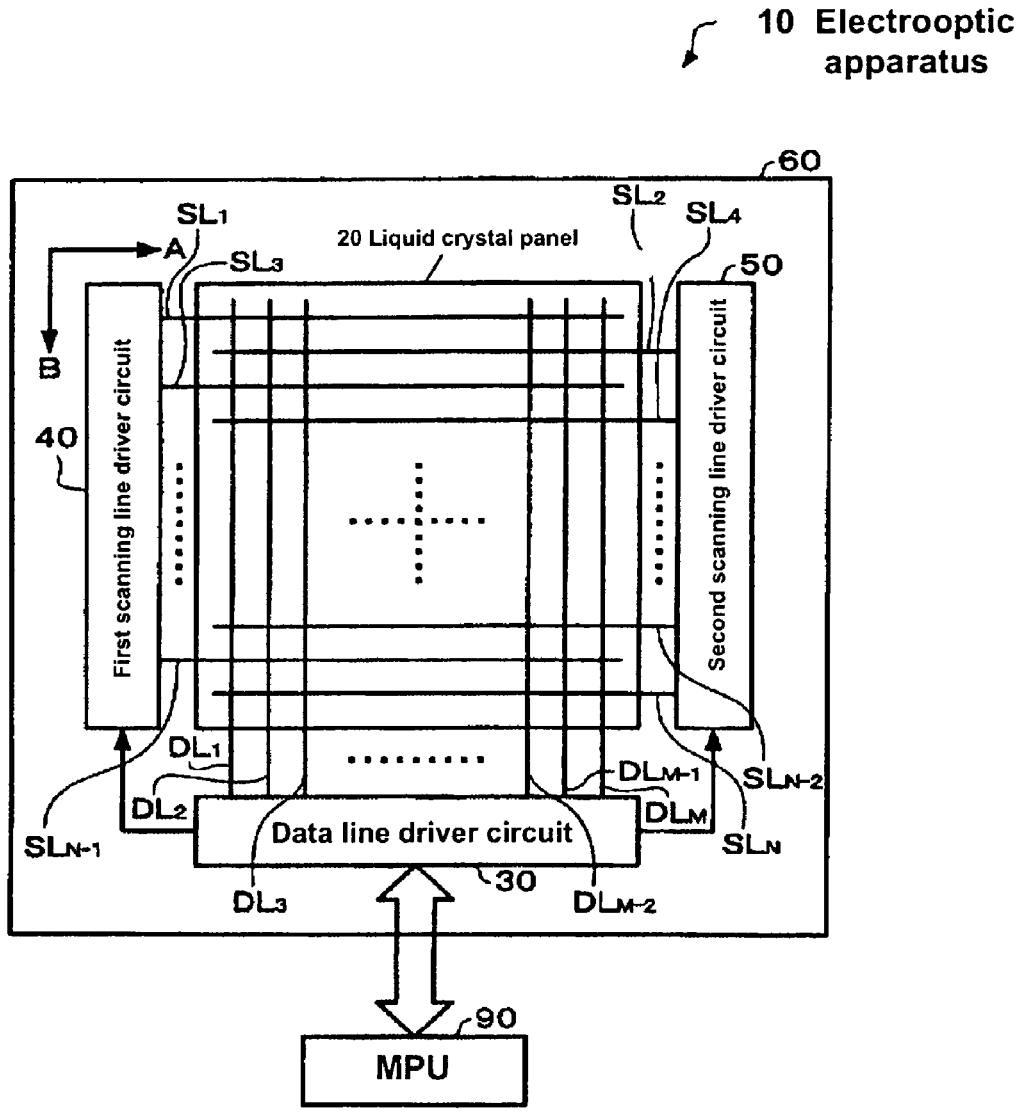
FIG. 1 shows a block diagram of a structural example of an electrooptic apparatus in accordance with aspects of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the size of functional units are exaggerated for clarity. Like numbers refer to like elements throughout It will be understood that when an element such as a circuit, portion of a circuit, logic unit or line is referred to as being "connected to" another element, it can be directly connected to the other element or intervening elements may also be present. In contrast, when an element is referred to as being "directly connected to" another element, there are no intervening elements present. When an element such as a circuit, portion of a circuit, logic unit or line is referred to as being "adjacent" another element, it can be near the other element but not necessarily independent of the other element. When an element such as a circuit, portion of a circuit, logic unit or line is referred to as being "between" two things, it can be either partly of completely between those two things, but is not necessarily completely and continuously between those two things. The term "adapted to" should be construed to mean "capable of".

Practice of preferred aspects of the present invention can provide electrooptic apparatuses, an electronic apparatuses and a semiconductor devices that can include scanning line driver circuits that are adapted to narrow intervals of scanning lines of the scanning line driver circuit to values exceeding the limitation value of the output pitch of the scanning line driver circuit. Such scanning line driver circuits can accomplish this without harming the versatility of a data line driver circuit. These scanning line driver circuits can therefore narrow the gap of their scanning lines to values beyond the limit of their output pitch without harming the versatility of data line driver circuits.

Such scanning line driver circuits can include, for example, a scanning control signal generation circuit, a selection output circuit, and a scanning driving circuit. The scanning control signal generation circuit can include a first scanning control signal generation circuit that can generate a first scanning control signal for scan-driving a first group of scanning lines, and a second scanning control signal generation circuit that can generate a second scanning control signal for scan-driving a second group of scanning lines. The selection output circuit can select and output one of the first scanning control signal and the second scanning control signal as a scanning control signal based on positional information inputted from a data line driver circuit. The scanning driving circuit can supply scanning signals for scan-driving to the respective scanning lines based on the scanning control signal that has been selected and outputted.

Aspects of the present invention can provide a scanning line driver circuits that drives a first group or a second group of scanning lines of an electrooptic apparatus in which pixels are defined by a plurality of data lines and a first group or a second group of scanning electrodes mutually traversing one another, wherein the scanning line driver circuit characterized in comprising: a circuit that generates a scanning control signal for driving at least one of the first group of scanning lines and the second group of scanning lines from a given display control signal provided from a data line driver circuit that data-drives the plurality of data lines based on given positional information; and a driver circuit that outputs a scanning signal based on the scanning control signal.

In such scanning line driver circuits, in accordance with some aspects of the present invention, a scanning control signal, which is for scanning the first group of scanning lines or the second group of scanning lines that cross data lines for specifying pixels, is generated based on given positional information, and the first group or the second group of scanning lines is driven based on the scanning control signal. Accordingly, when the scan-driving method for an electrooptic apparatus may be differentiated depending on a disposed position of a scanning line driver circuit, the scanning line driver circuit can internally accommodate scan-driving that is according to its disposed location. Therefore, there is no need for a circuit external to the scanning line driver circuit to recognize the disposed position of the scanning line driver circuit.

Consequently, an external circuit, which controls the scanning line driver circuit, does not need to perform different controls for the scanning line driver circuit depending on the disposed position thereof; and when it is operated to drive a liquid crystal device in cooperation with a plurality of scanning line driver circuits, it can perform a control that is common to the respective circuits, whereby its versatility can be improved. This also contributes to lowering the costs of external circuits.

Aspects of the present invention can also provide scanning line driver circuits that drives a first group of scanning lines or a second group of scanning lines of an electrooptic apparatus in which pixels are defined by a plurality of data lines and the first group or the second group of scanning electrodes mutually traversing one another, wherein the scanning line driver circuit is characterized in comprising: a circuit that generates a first scanning control signal for driving the first group of scanning lines based on a given display control signal provided from a data line driver circuit that data-drives the plurality of data lines; a circuit that generates a second scanning control signal for driving the second group of scanning lines based on the given display control signal; a selection output circuit that selects and outputs one of the first scanning control signal and the second scanning control signal; and a driver circuit that outputs a scanning signal based on the scanning control signal selected and outputted. The given display control signal can include a validation signal that validates edges of the scanning signal for scan-driving, and the driver circuit outputs a driving signal that is validated by the validation signal.

In such scanning line driver circuits, in accordance with still other aspects of the present invention, first and second scanning control signals for driving the first group and second group of scanning lines are generated based on a given display control signal provided from a data line driver circuit, and the first group or the second group of scanning lines is driven based on one of the scanning control signals. Accordingly, when the scan-driving method for an electrooptic apparatus may be differentiated depending on a disposed position of a scanning line driver circuit, the scanning line driver circuit can internally accommodate scan-driving that is according to its disposed location. Therefore, there is no need for the data line driver circuit that controls scanning timings of the first group and second group of scanning lines of the scanning line driver circuit to recognize the disposed position of the scanning line driver circuit.

The data line driver circuit does not need to perform different controls for the scanning line driver circuit depending on the disposed positions thereof; and when it is operated to drive a liquid crystal device in cooperation with a plurality of scanning line driver circuits, it can perform a control that is common to the respective circuits, whereby its versatility can be improved. In particular, because the data line driver circuit needs to drive data signals based on display data and to accommodate changes in the number of display colors, the above more effectively improves the versatility also contributes to lowering the costs.

Other aspects of the present invention are characterized in that the selection output circuit selects and outputs one of the first scanning control signal and the second scanning control signal based on positional information indicative of a position defined with the data line driver circuit as a reference. Positional information indicative of the disposed location of the scanning line driver circuit that is subject to the control is used with the disposed location of the data line driver circuit as a reference, whereby the positional information is simplified and the circuit structure can be realized with a simpler structure. According to other aspects of the present invention, the positional information is supplied by the data line driver circuit. Because the data line driver circuit supplies positional information, the data line driver circuit can realize any desired scan-driving control with respect to the first group and the second group of scanning lines.

The driver circuit can output the scanning signal to one of the first group and the second group of scanning lines in which the lines are in comb teeth configurations and alternately disposed with one another. Since scan-driving can be conducted alternately for the scanning lines that are arranged in comb teeth configurations, the gaps of the scanning lines of the panel can be narrowed without being restricted by the output pitch of the scanning line driver circuit. As a result, the number of pixels per unit area can be increased, which contributes to providing an electrooptic apparatus that is capable of displaying pictures at higher resolutions.

The first group or the second group of scanning lines can be scan-driven by using, for example, a thinning-out driving control signal that is used for a thinning-out driving operation, which enables more effective scan-driving controls.

The plurality of data lines and the first group and the second group of scanning lines can be connected to switching elements. Aspects of the present invention can contribute to realizing high-resolution picture displays by an electrooptic apparatus using switching elements such as TFDs and TFTs.

Other aspects of the present invention comprise a circuit that sets one of a comb teeth driving mode that alternately scan-drives lines in the first group and the second group of scanning lines and a normal driving mode that successively drives the scanning lines in the first group and the second group of scanning lines, respectively. The driver circuit outputs, when the comb teeth driving mode is set, one of the first scanning signal and the second scanning signal generated based on the first scanning control signal and the second scanning control signal as a scanning signal, and outputs, when the normal driving mode is set, a scanning signal generated based on the given display control signal.

In the comb teeth driving mode a comb teeth driving operation can be conducted by generating scanning signals by one of the first scanning control signal and the second scanning control signal that are generated based on the display control signal according to the positional information. In the normal driving mode each of the first group and the second group of scanning lines can be successively driven by switching one from the other by a mode setting operation. This can flexibly accommodate any scan-driving modes that may be changed according to mounting conditions of the scanning line driver circuit.

The scanning line driver circuits mentioned above may be implemented in an electrooptic apparatus that also comprises pixels that are defined by a plurality of data lines and a first group of scanning lines or a second group of scanning lines mutually traversing one another, and a data line driver circuit that data-drives the plurality of data lines. Consequently, electrooptic apparatuses with a substantially increased number of pixels per unit can be provided without being restricted by the output pitch of the scanning line driver circuit. Other aspects of the present invention are characterized in that the first scanning line driver circuit for scan-driving the first group of scanning lines, the data line driver circuit, and the second scanning line driver circuit for scan-driving the second group of scanning lines are successively disposed adjacent to a region where the pixels are formed and in an arrangement direction in which the plurality of data lines are arranged. In accordance with still other aspects of the present invention, the scanning line driver circuit is not disposed adjacent to either of the sides of the arrangement direction of the data lines among areas adjacent to a region where the pixels are formed, whereby narrower frames can be realized in electrooptic apparatuses.

Aspects of the present invention can also provide electrooptic apparatuses comprising a panel including pixels that are defined by a plurality of data lines and a first group of scanning lines or a second group of scanning lines mutually traversing one another; the first and second scanning line driver circuits set forth above, and a data line driver circuit that data-drives the plurality of data lines. Accordingly, aspects of the present invention can provide electrooptic apparatuses with a substantially increased number of pixels per unit can be provided without being restricted by the output pitch of the scanning line driver circuit. The first scanning line driver circuit for scan-driving the first group of scanning lines, the data line driver circuit, and the second scanning line driver circuit for scan-driving the second group of scanning lines can be successively disposed along a first side of the panel in parallel with an arrangement direction in which the plurality of data lines are arranged. In preferred embodiments of the present invention, the scanning line driver circuit is not disposed on either side of the arrangement direction of the data lines among peripheral areas extending along respective sides of the panel, whereby narrower frames can be realized in electrooptic apparatuses.

Aspects to the present invention can also provide an electronic apparatus that includes any one of the electrooptic apparatuses described above. In accordance with aspects of the present invention, symmetrical configurations can be maintained on both sides of the display section, and therefore the asthetic design of the electronic apparatus would not be harmed.

Aspects of the present invention can provide semiconductor devices that can be composed such that they include any one of the scanning line driver circuits described above, and a terminal for inputting the positional information and/or a terminal for inputting the validation signal and/or a terminal for setting a driving mode to the comb teeth driving mode or to the normal driving mode.

Now, further discussion of preferred aspects of scanning line driver circuits is provided with reference to the accompanying drawings.

Electrooptic Apparatus

FIG. 1 shows one example of a structure of an electrooptic apparatus in accordance with certain aspects of the present invention.

An electrooptic apparatus 10 can include, for example, a liquid crystal panel ("panel" in a broader sense) 20, a data line driver circuit (i.e., X driver or SEG driver) 30, and first and second scanning line driver circuits (i.e., Y drivers or COM drivers) 40 and 50. The liquid crystal panel 20, the data line driver circuit 30, and the first and second scanning line driver circuits 40 and 50 are mounted on a substrate 60. The substrate 60 may be a transparent insulation substrate, printed substrate, flexible substrate or the like that is capable of electrically connecting the liquid crystal panel to each of the driver circuits. In the present embodiment, a glass substrate is used.

The liquid crystal panel 20 can include, for example, multiple regions along a direction A, and also multiple regions along a direction B. One region among the multiple regions provided in the direction A and one region among the multiple regions provided in the direction B are specified to specify one pixel (dot). As an example, when there are 160 regions in the direction A and 120 regions in the direction B, the liquid crystal panel 20 has 160×120 pixels. Each of the pixel regions can include, for example, an active element (switching element).

In order to specify regions corresponding to the pixels, the liquid crystal panel 20 can include multiple data lines $DL_1$–$DL_M$ (M is a natural number of 2 or greater) arranged in the direction A, and multiple scanning lines $SL_1$–$SL_N$ (N is a natural number of 2 or greater) arranged in the direction B.

Figure 2:
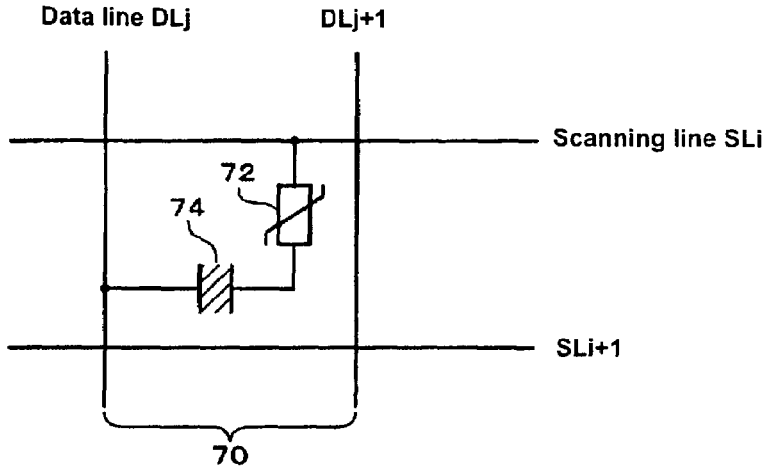
FIG. 2 shows an example of a pixel structure of a liquid crystal panel.

FIG. 2 shows an example of a pixel structure of the liquid crystal panel 20. The figure shows a structural example of a pixel in which a pixel region 70 that is defined by a data line and a scanning line and can include, for example, a thin film diode (TFD) as a two-terminal nonlinear element (two-terminal switching element). In this case, in the pixel region 70, a TFD 72 and electrooptic material (liquid crystal material) 74 are electrically, serially connected between a scanning line $SL_i$ ($1 \leqq j \leqq N$, where j is a natural number) and a data line $DL_j$ ($1 \leqq j \leqq N$, where j is a natural number). In this example, the TFD 72 is connected to the scanning line $SL_i$ side, and the electrooptic material 74 is connected to the data line $DL_j$ side. Conversely, the TFD 72 may be connected to the data line $DL_j$ side and the electrooptic material 74 may be connected to the scanning line $SL_i$ side.

The TFD 72 can be controlled to turn on and off by a potential difference between the scanning line $SL_i$ and the data line $DL_j$. Therefore, during a period in which the pixel is selected, and a voltage greater than a threshold voltage of the TFD 72 is applied, the TFD 72 turns on such that a data signal supplied on the data line $DL_j$ is written in the electrooptic material 74. On the other hand, during a period in which the pixel is not selected, the potential on the scanning line $SL_i$ is set such that a potential difference between the scanning line $SL_i$ and the data line $DL_j$ is smaller than the threshold voltage of the TFD 72.

By controlling the potential to be set on the scanning line $SL_i$ in this manner, potentials that correspond to data signals supplied to the data line $DL_j$ can be stored. By this, the static property of the electrooptic material 74 can be fully utilized, and higher image quality of pixels can be attained.

The multiple data lines for specifying the pixels described above can be connected to multiple output terminals of the data line driver circuit 30. Also, the multiple scanning lines can be connected to multiple output terminals (output pads, output electrodes) of the first and second scanning line driver circuits 40 and 50.

As shown, the multiple scanning lines arranged along the direction B can be provided in comb teeth configurations. In other words, the scanning lines of the liquid crystal panel 20 can be alternately connected to the output terminals of the first and second scanning line driver circuits 40 and 50 along the direction B. Therefore, the scanning lines arranged along the direction B of the liquid crystal panel 20 can be connected in the following manner. For example, when odd numbered ones of the scanning lines (a first group of scanning lines) can be connected to the first scanning line driver circuit 40 (one of the scanning line driver circuits), even numbered ones of the scanning lines respectively arranged on both sides of the odd numbered ones can be connected to the second scanning line driver circuit 50 (the other scanning line driver circuit).

Figure 3:
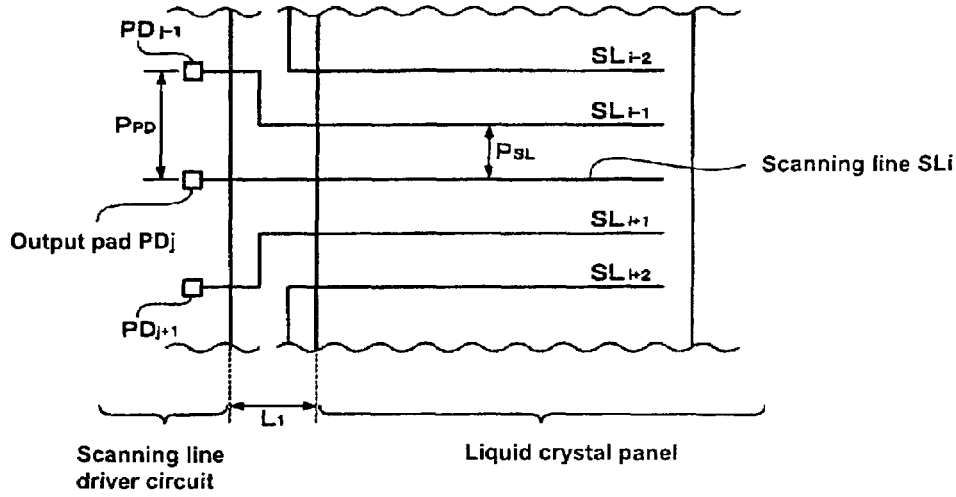
FIGS. 3(A) and 3(B) are explanatory diagrams that schematically show scanning lines that are connected in comb teeth configurations.
Figure 3:
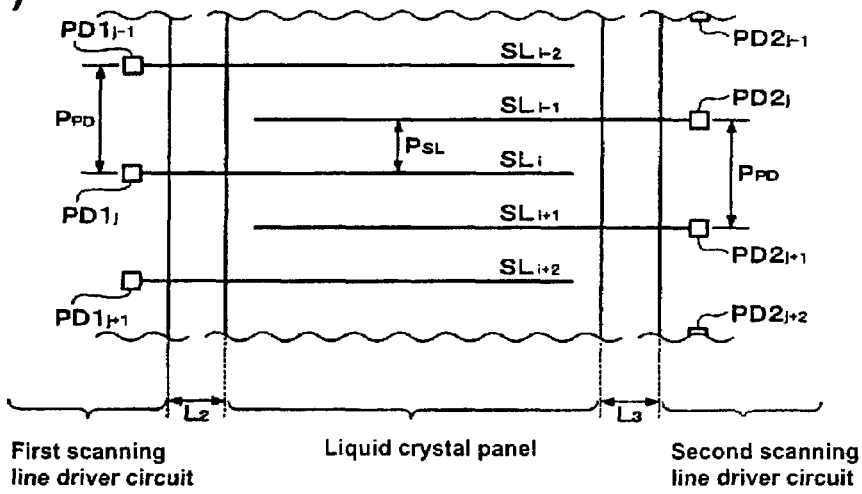

FIGS. 3(A) and 3(B) are schematic diagrams for describing the scanning lines that can be connected in comb teeth configurations. These figures show only output pads of the scanning line driver circuit to which the scanning lines can be connected, and illustration for the data lines can be omitted.

The scanning lines $SL_1$–$SL_N$ of the liquid crystal panel 20 can be arranged at intervals of pitch $P_{SL}$, respectively. The scanning line driver circuit has output pads $PD_1$–$PD_M$ arranged at intervals of output pad separation (output pitch) $P_{PD}$.

Here, let us consider one case in which the pitch $P_{SL}$ of the scanning lines can be made smaller, in order to increase the number of pixels per unit area.

The output pad interval $P_{PD}$ of the scanning line driver circuit has a limit value that can be permissible in view of the fabrication thereof according to the design rule, which can be determined by required high breakdown voltage resistance property and noise breakdown resistance property. Accordingly, when the pitch $P_{SL}$ of the scanning lines of the liquid crystal panel 20 can be made smaller, the output pad interval $P_{PD}$ encounters the limitation imposed by the design rule; and when the pitch $P_{SL}$ reaches a certain value and smaller, the output pad interval cannot be further reduced, and as a result, it deviates from the output pad interval $P_{PD}$ of the scanning line driver circuit.

For example, let us assume that a scanning line $SL_i$ is connected to an output pad $PD_j$ of the scanning line driver circuit, and scanning lines $SL_{i-1}$ and $SL_{i+1}$ is connected to output pads $PD_{j-1}$ and $PD_{j+1}$, respectively. In this instance, as shown in FIG. 3(A), due to a deviation between the output pad interval $P_{PD}$ of the scanning line driver circuit and the pitch $P_{SL}$ of the scanning lines, wirings need to be bent to connect the scanning lines $SL_{i-1}$ and $SL_{i+1}$ to the output pads $PD_{j-1}$ and $PD_{j+1}$ of the scanning line driver circuit, respectively. Accordingly, the more the number of scanning lines increases, the greater the distance $L_1$ between the scanning line driver circuit and the liquid crystal panel 20 become, which results in an increase in the mounting area.

In contrast, as shown in FIG. 3(B), the first and second scanning line driver circuits 40 and 50 can be provided for the liquid crystal panel 20, and scanning lines can be alternately connected to the both scanning line driver circuits 40 and 50. By this structure, even when there can be a deviation between the output pad interval $P_{PD}$ of the scanning line driver circuit and the pitch $P_{SL}$ of the scanning lines, adjacent ones of the output pads can be connected to every other scanning line. As a result, a wiring bending region can be provided without much difficulty, and the distance $L_2$ and $L_3$ between the liquid crystal panel 20 and the first and the second scanning line driver circuit 40 and 50 can be made smaller. Accordingly, the mounting area can be more effectively utilized.

In particular, when the pitch $P_{SL}$ of the scanning lines can be half of the output pad interval $P_{PD}$ of the scanning line driver circuit, each of the scanning lines can be connected without being bent to respective one of the output pads of the scanning line driver circuit, and therefore the distance $L_2$ and $L_3$ can be minimized.

Referring again to FIG. 1, the data line driver circuit 30, which drives data lines traversing the scanning lines connected in such comb teeth configurations, outputs data signals for driving the liquid crystal panel 20. The data line driver circuit 30 may include a RAM (random access memory) that stores, for example, image data, and connects to an external MPU (micro processor unit) 90. The data line driver circuit 30 receives from the MPU 90 image data, addresses that control storage regions of the RAM that stores the image data, or a variety of control signals for performing write control and read control.

The data line driver circuit 30 generates, based on the image data stored in the RAM, data signals to be supplied to the multiple data lines arranged along the direction A of the liquid crystal panel 20.

Also, the data line driver circuit 30 supplies display control signals to the first and second scanning line driver circuits 40 and 50 to thereby work in cooperation with the first and second scanning line driver circuits 40 and 50 to display images at the liquid crystal panel 20.

The first scanning line driver circuit 40 generates, based on the display control signal supplied from the data line driver circuit 30, scanning signals for scanning the liquid crystal panel 20, and scans in a vertical scanning period a plurality of scanning lines (a first group of scanning lines) $SL_1$, $SL_3$, . . . , and $SL_{N-1}$ arranged along the direction B of the liquid crystal panel 20 among the multiple scanning lines $SL_1$–$SL_N$. It should be noted that, as used herein, N is presumed to be an even number for the convenience of description.

The second scanning line driver circuit 50 generates, based on the display control signal supplied from the data line driver circuit 30, scanning signals for scanning the liquid crystal panel 20, and scans in a vertical scanning period a plurality of scanning lines (a second group of scanning lines) $SL_2$, $SL_4$, . . . , and $SL_N$ arranged along the direction B of the liquid crystal panel 20.

The first and second scanning line driver circuits 40 and 50 alternately perform scanning for each scanning period based on the display control signal supplied from the data line driver circuit 30, to thereby successively scan in a vertical scanning period the scanning lines $SL_1$, $SL_2$, $SL_3$, . . . , $SL_{N-1}$, and $SL_N$ arranged along the direction B of the liquid crystal panel 20.

It should be appreciated that, in electrooptic apparatuses, while the size of liquid crystal panels can be becoming larger in association with increases in the data amount to be displayed, there can be a tendency that the areas of data line driver circuits and scanning line driver circuits can be getting smaller due to advances in semiconductor device manufacturing technology. Under such circumstances, each of the components of the electrooptic apparatus can be structured as follows.

Figure 4:
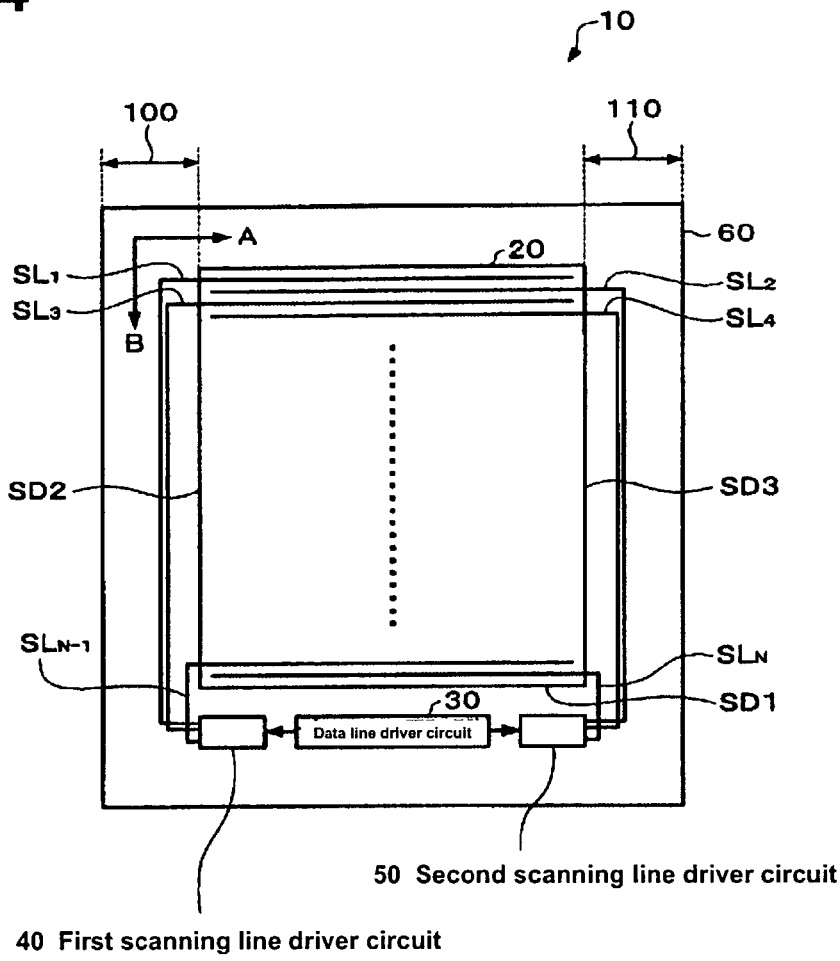
FIG. 4 is an explanatory diagram that shows an example of positions of components of an electrooptic apparatus in accordance with the aspects of the present invention.

FIG. 4 shows an example of positions of the respective components of the electrooptic apparatus in accordance with aspects of the present invention. Components that are functionally similar to the components of the electrooptic apparatus shown in FIG. 1 are indicated by the same reference numbers and their description may be omitted if appropriate. Also, illustration for the data lines arranged along the direction A is omitted.

The liquid crystal panel 20 of the electrooptic apparatus 10 has four sides along its circumference, wherein one of the sides that extends along an arrangement direction in which the data lines can be arranged (a direction A, or a direction in which the scanning lines extend) and that can be closer to a position where the data line driver circuit 30 can be disposed can be defined as a first side SD1. In this instance, a first scanning line driver circuit 40 that scan-drives a first group of scanning lines $SL_1$, $SL_3$, . . . , and $SL_{N-1}$ , the data line driver circuit 30, and a second scanning line driver circuit 50 that scan-drives a second group of scanning lines $SL_2$, $SL_4$, . . . , $SL_N$ can be successively disposed adjacent to the liquid crystal panel 20 and along the first side SD1.

Accordingly, the first and second scanning line driver circuits 40 and 50, without being disposed along second and third sides SD2 and SD3 that can be perpendicular to the first side SD1 of the liquid crystal panel 20, can be connected by wirings to the scanning lines arranged along the direction B. As a result, the lengths 100 and 110 on both sides of the liquid crystal panel 20 can be shortened, such that the frame of the electrooptic apparatus 10 can be narrowed. Moreover, since a symmetrical configuration can be maintained with respect to the sides thereof, the beauty of design in an electronic apparatus that uses the electrooptic apparatus 10 at its display section would not be harmed.

When the driver circuits can be mounted on the same substrate where the pixels can be disposed, the first scanning line driver circuit 40 that scan-drives the first group of scanning lines $SL_1$, $SL_3$, . . . , and $SL_{N-1}$, the data line driver circuit 30, and the second scanning line driver circuit 50 that scan-drives a second group of scanning lines $SL_2$, $SL_4$, . . . , $SL_N$ may be successively disposed adjacent to the pixel region along the arrangement direction of the multiple data lines.

Driving Waveform

The liquid crystal panel 20 has TFDs as switching elements in the pixel regions, and performs a thinning-out driving operation in order to prevent degradation of the display quality.

The thinning-out driving operation can be a driving operation in which periods for applying selection voltages to scanning lines in a selection period can be thinned out to thereby maintain constant leaks at the TFDs during a non-selection period.

Figure 5:
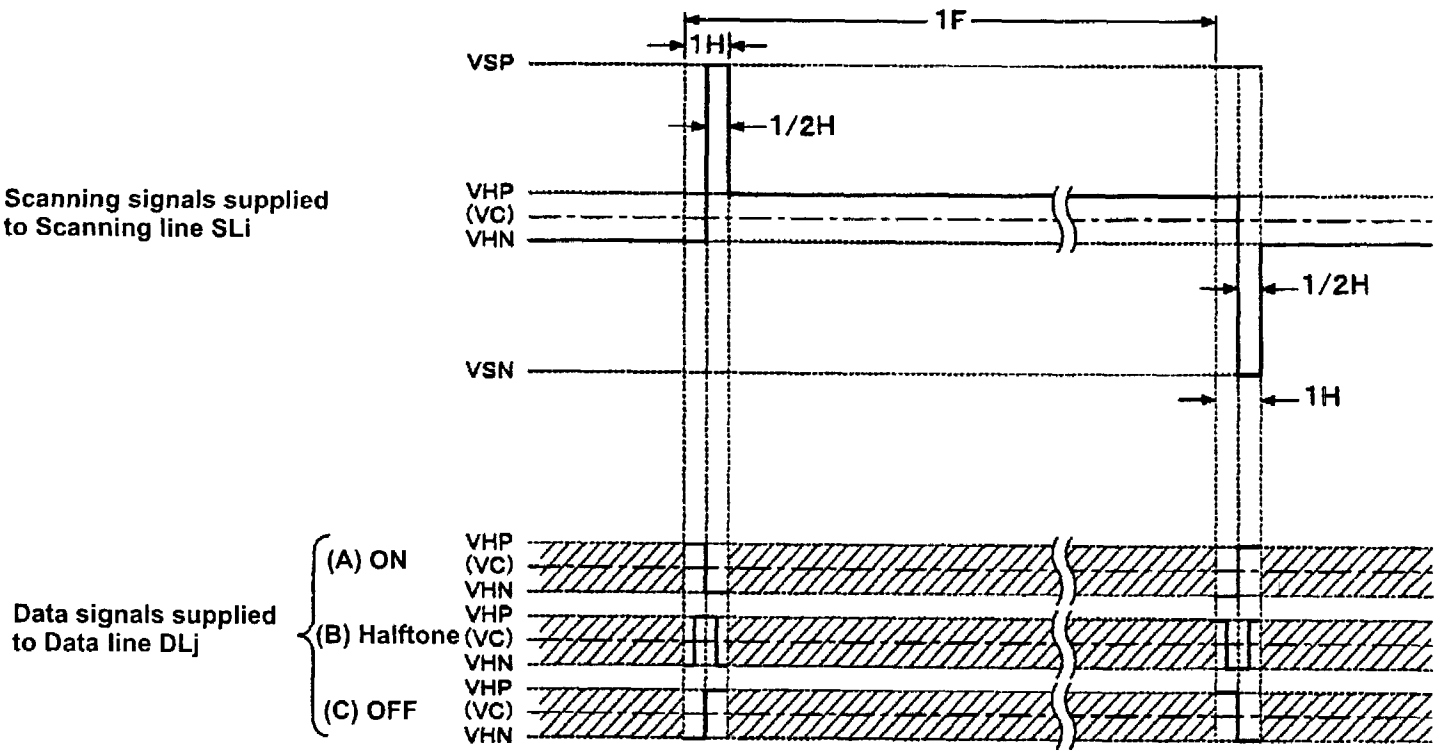
FIG. 5 is an illustration for describing driving waveforms (A), (B) and (C) for a thinning-out driving operation.

FIG. 5 shows driving waveforms (A), (B) and (C) for describing the thinning-out driving operation. Here, a pixel that can be defined by the scanning line $SL_i$ and the data line $DL_j$ can be considered, and therefore a scanning signal that is supplied to the scanning line $SL_i$ and a data signal that is supplied to the data line $DL_j$ can be indicated.

The scanning line $SL_i$ can be selected once during a period 1 F (one frame), and receives a scanning signal whose polarity can be inverted at each frame. Here, voltages VSP and VSN can be selection voltages at positive polarity and negative polarity, respectively. Voltages VHP and VHN can be non-selection voltages at positive polarity and negative polarity, respectively. Voltages VHP and VHN can be voltages respectively at a higher potential side and a lower potential side of the data signal that can be supplied to the data line $DL_j$. The selection voltages VSP and VSN can be symmetrical about an intermediate voltage VC as a reference between the high voltage side and the low voltage side of the data signal. Therefore, an AC voltage can be applied to the electrooptic material 74 shown in FIG. 2 at each frame.

A scanning signal that can be supplied to the scanning line $SL_i$ becomes to be the selection voltage VSP only during a latter half period (0.5 H) of one horizontal scanning period (1 H) during which the scanning line $SL_i$ is selected, and becomes to be the non-selection voltage VHP thereafter. Also, the scanning signal that can be supplied to the scanning line $SL_i$ becomes to be the selection voltage VSN only during a latter half period (0.5 H) of the next selection period 1 H, and thereafter becomes to be the non-selection voltage VHN. Thereafter, the scanning signal repeatedly changes in a similar manner.

In the mean time, when the display content of the pixel that is defined by the scanning line $SL_i$ and the data line $DL_j$ assumes an ON display, a data signal that can be supplied to the data line $DL_j$ becomes to be the high potential side voltage VHP during a first half period (a first half 0.5 H) of the horizontal scanning period, for example, and becomes to be the low potential side voltage VHN during a latter half period (a latter half 0.5 H), as shown in (A) of FIG. 5. In this case, in the next selection period, the data signal that is supplied to the data line $DL_j$ becomes to be the low potential side voltage VHN during a first half period (a first half 0.5 H) of the horizontal scanning period, and becomes to be the high potential side voltage VHP during a latter half period (a latter half 0.5 H).

Similarly, when the display content of the pixel that is defined by the scanning line $SL_i$ and the data line $DL_j$ assumes an OFF display, a data signal that is supplied to the data line $DL_j$ becomes to be the low potential side voltage VHN during a first half period (a first half 0.5 H) of the horizontal scanning period, for example, and becomes to be the high potential side voltage VHP during a latter half period (a latter half 0.5 H), as shown in (C) of FIG. 5. In this case, in the next selection period, the data signal that is supplied to the data line $DL_j$ becomes to be the high potential side voltage VHP during a first half period (a first half 0.5 H) of the horizontal scanning period, and becomes to be the low potential side voltage VHN during a latter half period (a latter half 0.5 H).

When displaying a halftone, a high potential side voltage or a low potential side voltage may be supplied as a data signal depending on the polarity of a scanning signal in a manner that the data signal bridges across an intermediate point of one horizontal scanning period, as shown in (B) of FIG. 5.

Also, in hatched regions in (A), (B) and (C) of FIG. 5, voltages, which are determined according to display contents of pixels defined by the data line $DL_j$ and other scanning lines and their polarities, can be supplied to the data line $DL_j$.

In this manner, in the case of ON display, during a latter half period of one horizontal scanning period, the polarity of the selection voltage of the scanning signal that is supplied to the scanning line $SL_i$ can be in a reverse polarity with respect to the polarity of the voltage of the data signal that is supplied to the data line $DL_j$. In contrast, in the case of OFF display, during a latter half period of one horizontal scanning period, the polarity of the selection voltage of the scanning signal that is supplied to the scanning line $SL_i$ can be in the same polarity with respect to the polarity of the voltage of the data signal that is supplied to the data line $DL_j$.

In other words, selection voltages with polarities mutually being reversed for 0.5 H each can be applied to the scanning line $SL_i$, and voltages at the high potential side and the low potential side can be supplied as data signals. Therefore, during a non-selection period, a constant voltage can be applied to the electrooptic material 74 without regard to display contents, such that the off-leak amount of the TFD 72 during a non-selection period can be made constant to prevent degradation of the display quality.

The thinning-out driving operation described above thins out only a first half period of 0.5 H of a scanning signal in one horizontal scanning period and uses a latter half period of 0.5 H thereof.

Data Line Driver Circuit And Scanning Line Driver Circuit

The data line driver circuit 30 receives from the MPU 90, as described above, image data, addresses that control storage regions of the RAM that stores the image data, or a variety of control signals for performing write control and read control. The data line driver circuit 30 generates, based on the image data stored in the RAM, data signals to be supplied to the multiple data lines arranged along the direction A of the liquid crystal panel 20.

Also, the data line driver circuit 30 outputs display control signals for scan-driving to the first and second scanning line driver circuits 40 and 50 to thereby work in cooperation with the first and second scanning line driver circuits 40 and 50 to display images on the liquid crystal panel 20. The first and second scanning line driver circuits 40 and 50 scan-drive the first group and second group of scanning lines based on the display control signals.

At this moment, the data line driver circuit 30 needs to control the first and second scanning line driver circuits 40 and 50 independently so that the scanning lines that are connected in comb teeth configurations described above can be alternately driven. However, if the data line driver circuit 30 were to output individual display control signals to the first and second scanning line driver circuits 40 and 50, the cost of the data line driver circuit 30 would become higher. Also, types of the data line driver circuit 30 tend to increase in order to accommodate changes in the number of display colors. Therefore the data line driver circuit 30 may preferably have a greater versatility without depending on driving methods.

Accordingly, the first and second scanning line driver circuits 40 and 50 can be display-controlled by the data line driver circuit 30 as shown in FIGS. 6(A) and 6(B) that illustrate and describe relations concerning connections between the first and second scanning line driver circuits 40 and 50 and the data line driver circuit 30. The first scanning line driver circuit 40, the data line driver circuit 30 and the second scanning line driver circuit 50 can be successively disposed along the first side SD1 of the liquid crystal panel 20.

The data line driver circuit 30 receives from the MPU 90, as described above, image data, addresses that control storage regions of the RAM that stores the image data, or a variety of control signals for performing write control and read control. The data line driver circuit 30 generates, based on the image data stored in the RAM, data signals to be supplied to the multiple data lines arranged along the direction A of the liquid crystal panel 20.

Also, the data line driver circuit 30 outputs POS1 signal, POS2 signal, DY signal, XINH signal and YSCL signal as display control signals to the first and second scanning line driver circuits 40 and 50.

POS1 signal and POS2 signal can be positional information indicating whether the scanning line driver circuits on signal receiving sides can be disposed on the right side or the left side of the data line driver circuit 30. By using the disposed position of the data line driver circuit 30 as a reference, the positional information can be simplified by expressing the right position and the left position by two values, and the circuit structure can be simplified. Based on POS1 signal and POS2 signal as positional information, the scanning line driver circuit on a signal receiving side generates timing for scan-driving the scanning lines connected in comb teeth configurations.

For example, the first scanning line driver circuit 40 determines, based on POS1 signal, that it is disposed on the left side of the data line driver circuit 30, and performs scan-driving in synchronism with the timing for scanning the first group of scanning lines. Also, the second scanning line driver circuit 50 can determine, based on POS2 signal, that it is disposed on the right side of the data line driver circuit 30, and can perform scan-driving in synchronism with the timing for scanning the second group of scanning lines.

DY signal, YSCL signal and XING signal can be commonly supplied from the data line driver circuit 30 to the first and second scanning line driver circuits 40 and 50, respectively.

DY signal can be a data input signal to shift registers of the first and second scanning line driver circuits. YSCL signal can be a shift clock input signal for display data. XINH signal (a validation signal in a broader sense) can be a signal that can be used to thin out the shift clock input signal to perform a thinning-out driving operation. By XINH signal, only edges of a scanning signal for a thinning-out driving operation can be made effective.

It should be noted that the first and second scanning line driver circuits 40 and 50 shown in FIG. 6(A) determine, based on POS1 signal and POS2 signal provided from the data line driver circuit 30, their disposed positions with respect to the data line driver circuit 30. However, they are not limited to this configuration.

For example, as shown in FIG. 6(B), a power supply level indicating that the first scanning line driver circuit 40 can be disposed on the left side of the data line driver circuit 30 and a ground level indicating that the second scanning line driver circuit 50 can be disposed on the right side of the data line driver circuit 30 may be inputted in terminals for inputting positional information about the first and second scanning line driver circuits 40 and 50, respectively. In this case, since the data line driver circuit 30 can supply only common display control signals to the first and second scanning line driver circuits 40 and 50, the versatility of the data line driver circuit 30 can be further improved.

Data Line Driver Circuit

Figure 7:
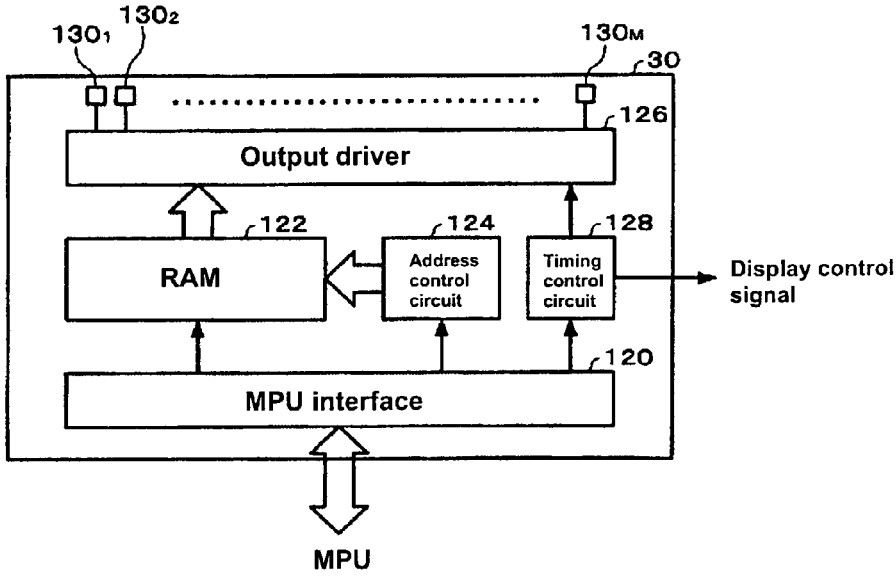
FIG. 7 is a block diagram of a structural example of a data line driver circuit.

FIG. 7 shows an example of a structure of the data line driver circuit 30. The data line driver circuit 30 can include, for example, an MPU interface 120, a RAM 122, an address control circuit 124, an output driver 126 and a timing control circuit 128. The MPU interface 120 can be an interface circuit that performs connection to the MPU 90. The RAM 122 stores image data that can be inputted from the MPU 90 through the MPU interface 120. The address control circuit 124 designates regions for storing image data in the RAM 122 according to addresses inputted from the MPU 90 through the MPU interface 120.

The output driver 126 generates data signals based on the image data stored in the RAM 122, and outputs the same to data electrodes $\mathbf{130}_1$–$\mathbf{130}_M$ respectively connected to the data lines $DL_1$–$DL_M$.

The timing control circuit 128 controls output timing of the data signals to be outputted to the data electrodes $\mathbf{130}_1$–$\mathbf{130}_M$. Further, the timing control circuit 128 controls output timing of scanning signals that are generated by the first and second scanning line driver circuits 40 and 50. The timing control circuit 128 supplies display control signals, such as YSCL signal that can be a line pulse to define a horizontal scanning timing, DY signal that can be a data input to the shift register, and XINH signal that validates edges of YSCL signal for performing a thinning-out driving operation, to the first and second scanning line driver circuits 40 and 50. Furthermore, the timing control circuit 128 supplies, as display control signals, positional information in the form of POS1 signal and POS2 signal to the first and second scanning line driver circuits 40 and 50, which indicates whether they can be disposed on the left side or the right side of the data line driver circuit 30.

The data line driver circuit 30 supplies common display control signals to each of the scanning lines, in addition to individually supplying a POS signal as positional information to each of the scanning line driver circuits, such that a scan-driving operation can be conducted at a timing required to scan by each of the scanning line driver circuits. By this, the data line driver circuit 30 does not depend on driving methods, such as, for example, the comb teeth driving method in which scanning lines connected in comb teeth configurations can be alternately driven and the normal driving method in which normal scanning lines can be successively driven, and therefore does not need to change signals to be supplied to the scanning line driver circuits. Accordingly, the versatility of the data line driver circuit 30 can be improved, and the cost can be lowered.

Scanning Line Driver Circuit

Figure 8:
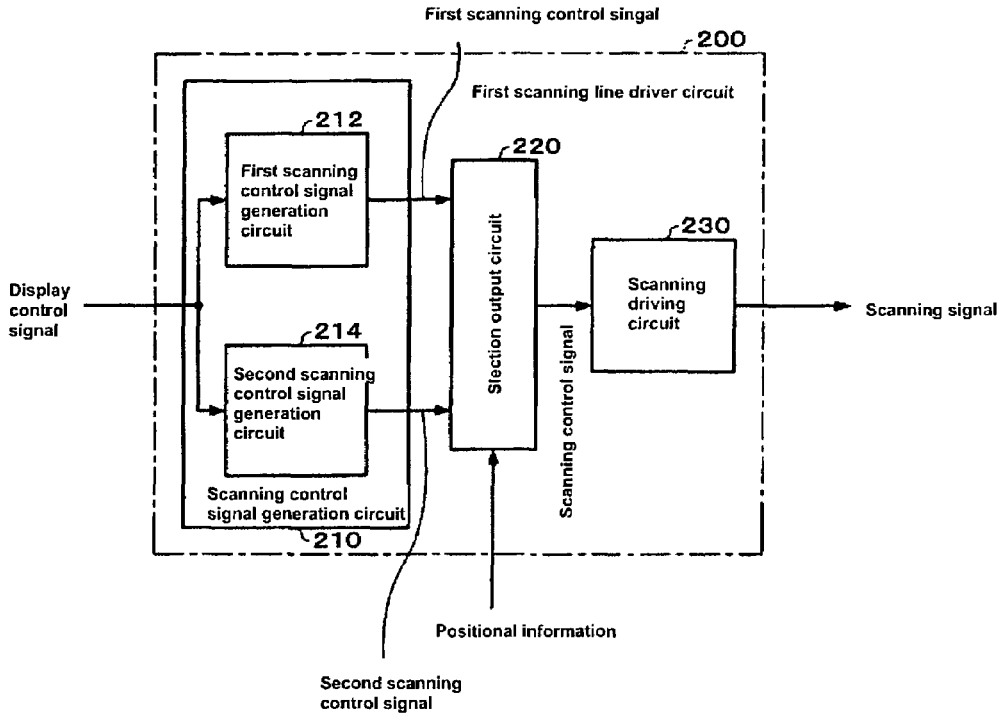
FIG. 8 shows a summary diagram of a structure of the principle of a scanning line driver circuit in accordance with the aspects of the present invention.

FIG. 8 shows a block diagram illustrating a scanning line driver circuit in accordance with aspects of the present invention. The first and second scanning line driver circuits 40 and 50 as shown can each have the same structure as that of a scanning line driver circuit 100 to be described below. Their operation can be also the same. The scanning line driver circuit 200 can include, for example, a scanning control signal generation circuit 210, a selection output circuit 220, and a scanning driving circuit 230.

The scanning control signal generation circuit 210 generates scanning control signals for conducting a scan-driving operation based on display control signals inputted from, for example, the data line driver circuit 30. More concretely, the scanning control signal generation circuit 210 can include, for example, a first scanning control signal generation circuit 212 that generates a first scanning control signal for scan-driving the first group of scanning lines, and a second scanning control signal generation circuit 214 that generates a second scanning control signal for scan-driving the second group of scanning lines.

The selection output circuit 220 selects and outputs one of the first and second scanning control signals as a scanning control signal based on positional information inputted from, for example, the data line driver circuit 30.

The scanning driving circuit 230 generates a scanning signal for conducting a scan-driving operation based on the scanning control signal selected and outputted by the selection output circuit 220, and supplies the same to the scanning lines.

Since the scanning line driver circuit 200 can be constructed to generate, according to the positional information, scanning signals according to one of the first and second scanning control signals that can be generated based on the display control signals, an appropriate comb teeth driving operation can be conducted only by the scanning line driver circuit side, when the lines of the first group and second group of scanning lines can be disposed in comb teeth configurations.

EXAMPLES

Figure 9:
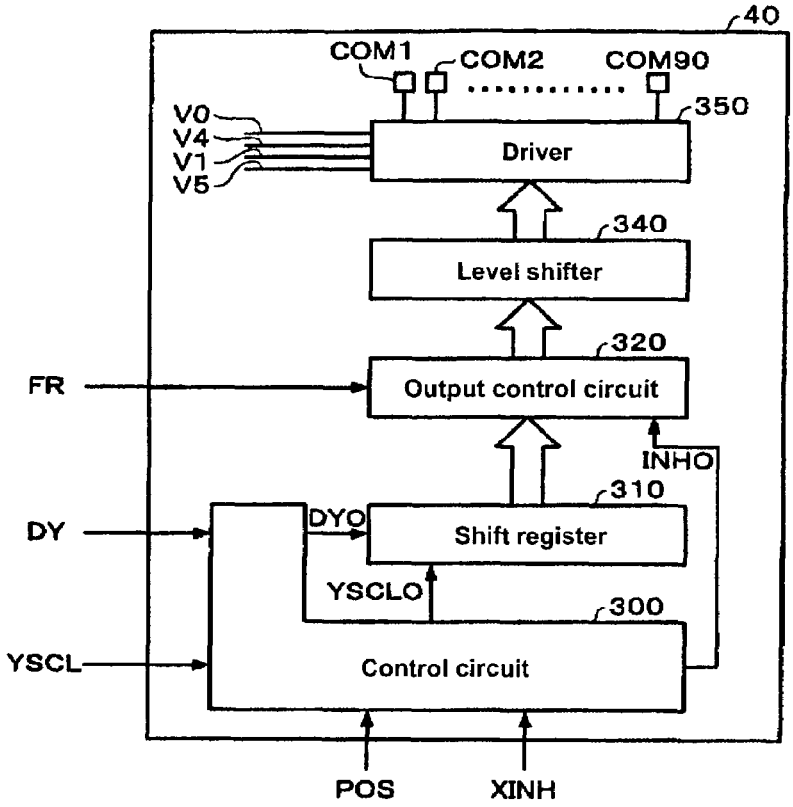
FIG. 9 is a block diagram that shows a structural example of a first scanning line driver circuit in accordance with the aspects of the present invention.

Next, a scanning line driver circuit implementing aspects of the invention described above in its control circuit will be described. FIG. 9 shows a structural example of the first scanning line driver circuit 40. Here, although description can be made for the first scanning line driver circuit 40, the same description applies to the second scanning line driver circuit 50.

The first scanning line driver circuit 40 can include, for example, a control circuit 300, a shift register 310, an output control circuit 320, a level shifter 340 and a driver 350.

The first scanning line driver circuit 40, when mounted in a semiconductor device, can be structured in a manner to include a terminal for inputting positional information and a terminal for inputting display control signals. Display control signals, which can be provided from the data line driver circuit 30, can be supplied to the terminals for inputting display control signals.

Figure 6:
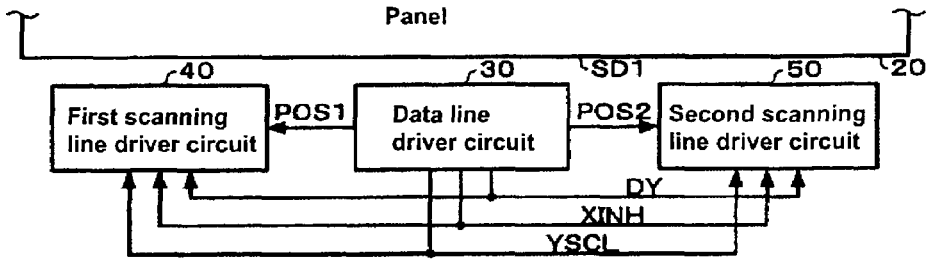
FIGS. 6(A) and 6(B) are explanatory diagrams that show relations in connecting first and second scanning line driver circuits and a data line driver circuit.
Figure 6:
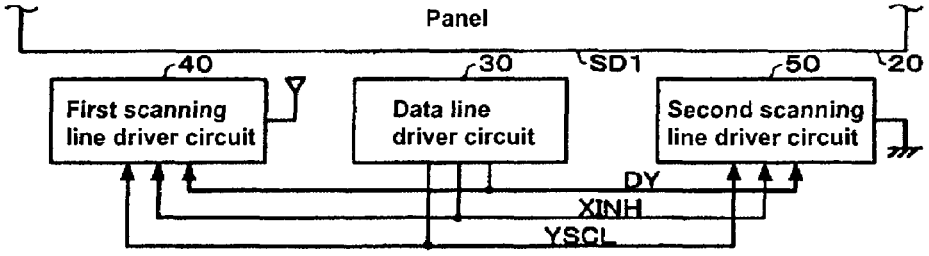

The control circuit 300 can be composed of logical circuits including the functional section indicated in FIG. 8, and generates scanning control signals (DYO signal, YSCLO signal, and INHO signal) based on control signals provided from the data line driver circuit 30, such as, DY signal, YSCL signal, POS signal (POS1 signal at (A) in FIG. 6), and XINH signal.

The control circuit 300 generates a first scanning control signal corresponding to the scanning timing for scan-driving the first group of scanning lines, and a second scanning signal corresponding to the scanning timing for scan-driving the second group of scanning lines.

The shift register 310 successively connects flip-flops provided according to the scanning lines, and successively shifts DYO signal generated by the control circuit 300 in synchronism with YSCLO signal.

The output control circuit 320 performs output controls for the signals whose levels can be shifted by the level shifter 340. The output control circuit 320 generates timings to output potentials V0, V1, V4 and V5, based on FR signal that can be an alternate signal for a liquid-crystal driving operation, according to a display access period and a non-display access period during a selection period, such that the polarities of the voltages to be applied to the liquid crystal can be inverted. Alternately, the output control circuit 320 masks and nullifies shift data inputted from the shift register 310 based on INHO signal generated by the control circuit 300.

The level shifter 340 shifts the voltage to a level according to the liquid crystal material of the liquid crystal panel 20.

The driver 350 outputs any of potentials V0, V1, V4 and V5 based on the signal inputted from the level shifter 340 to the scanning electrodes COM1–COM90 that connect to the scanning lines.

Figure 10:
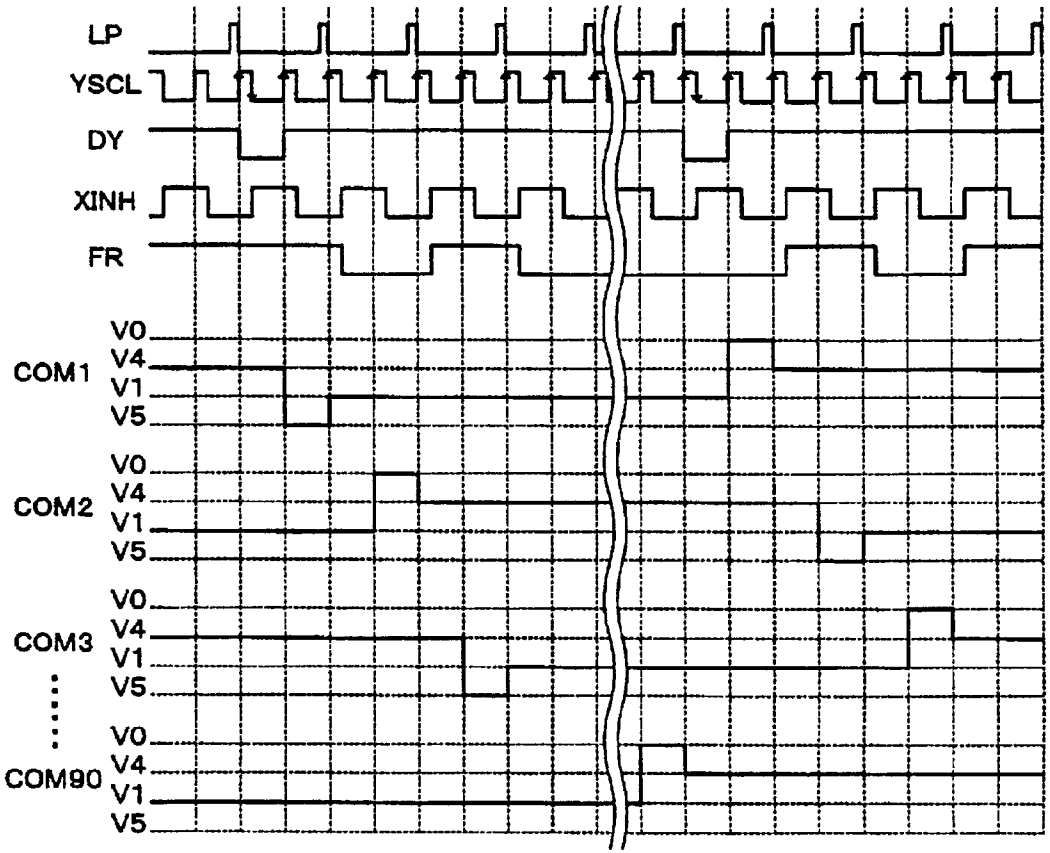
FIG. 10 is a timing chart of an example of driving waveforms of the first scanning line driver circuit in accordance with the aspects of the present invention.

As indicated in FIG. 10, the first scanning line driver circuit 40 outputs, in each horizontal scanning period that starts at a fall of YSCL signal and when DY signal is at "L" level, a scanning signal (scanning clock) whose latter half section is validated by XINH signal, to the scanning electrodes COM1–COM90.

Figure 11:
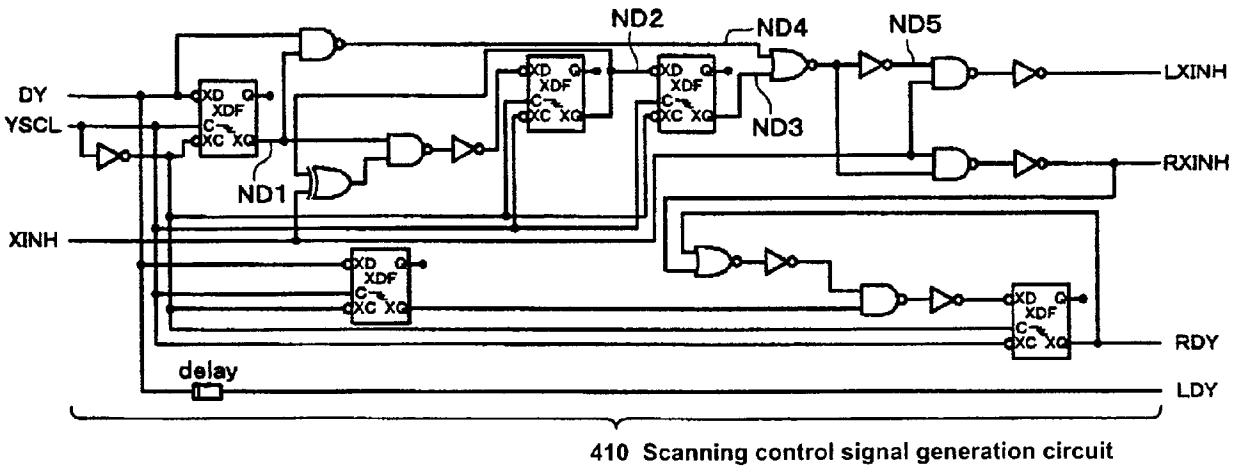
FIGS. 11(A) and (B) show a circuit diagram of a structural example of a control circuit in accordance with the aspects of the present invention.
Figure 11:
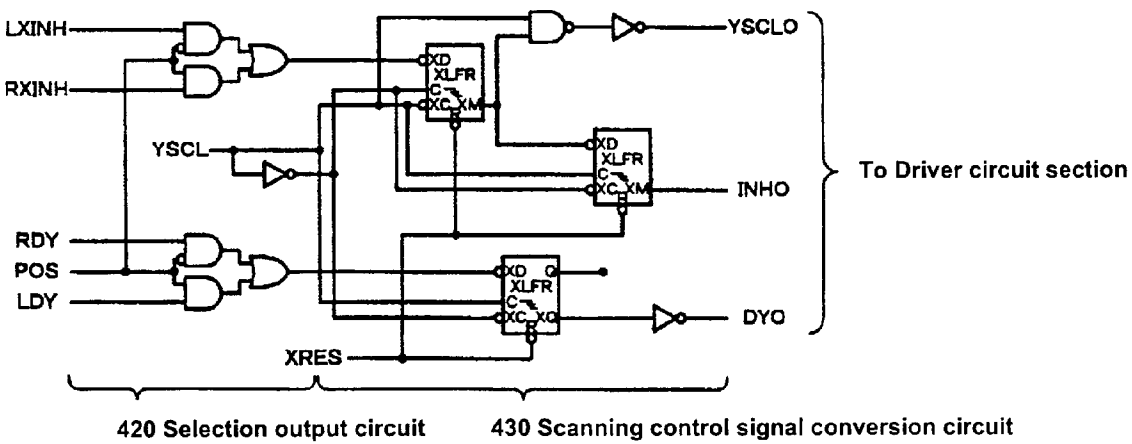

FIGS. 11(A) and (B) show an example of a structure of the control circuit 300. XRES signal can be a reversing reset signal. The control circuit 300 can include, for example, a scanning control signal generation circuit 410, a selection output circuit 420, and a scanning control signal conversion circuit 430.

The scanning control signal generation circuit 410 corresponds to the scanning control signal generation circuit 210 shown in FIG. 8. The selection output circuit 420 corresponds to the selection output circuit 220 shown in FIG. 8. The scanning control signal conversion circuit 430 converts signals to scanning control inputted signals to be outputted to the scanning driver circuit 230 shown in FIG. 8.

The scanning control signal generation circuit 410 generates LDY signal and LXINH signal among the first scanning control signals and RDY signal and RXINH signal among the second scanning control signals from DY signal, YSCL signal, XINH signal and POS signal supplied by the data line driver circuit 30.

Here, LDY signal means DY signal on the left (L) side, and RDY signal means DY signal on the right (R) side. Also, LXINH signal means XINH signal on the left (L) side, and the RXINH signal means XINH signal on the right (R) side.

The selection output circuit 420 selects and outputs one of LXINH signal and RXINH signal and one of LDY signal and RDY signal based on POS signal as positional signal.

The scanning control signal conversion circuit 430 generates YSCLO signal that is a logical product of YSCL signal inputted from the data line driver circuit 30 and one of LXINH signal and RXINH signal. Also, the scanning control signal conversion circuit 430 generates INHO signal in which one of LXINH signal and RXINH signal can be latched. Furthermore, the scanning control signal conversion circuit 430 generates DYO signal in which one of LDY signal and RDY signal can be latched.

Figure 12:
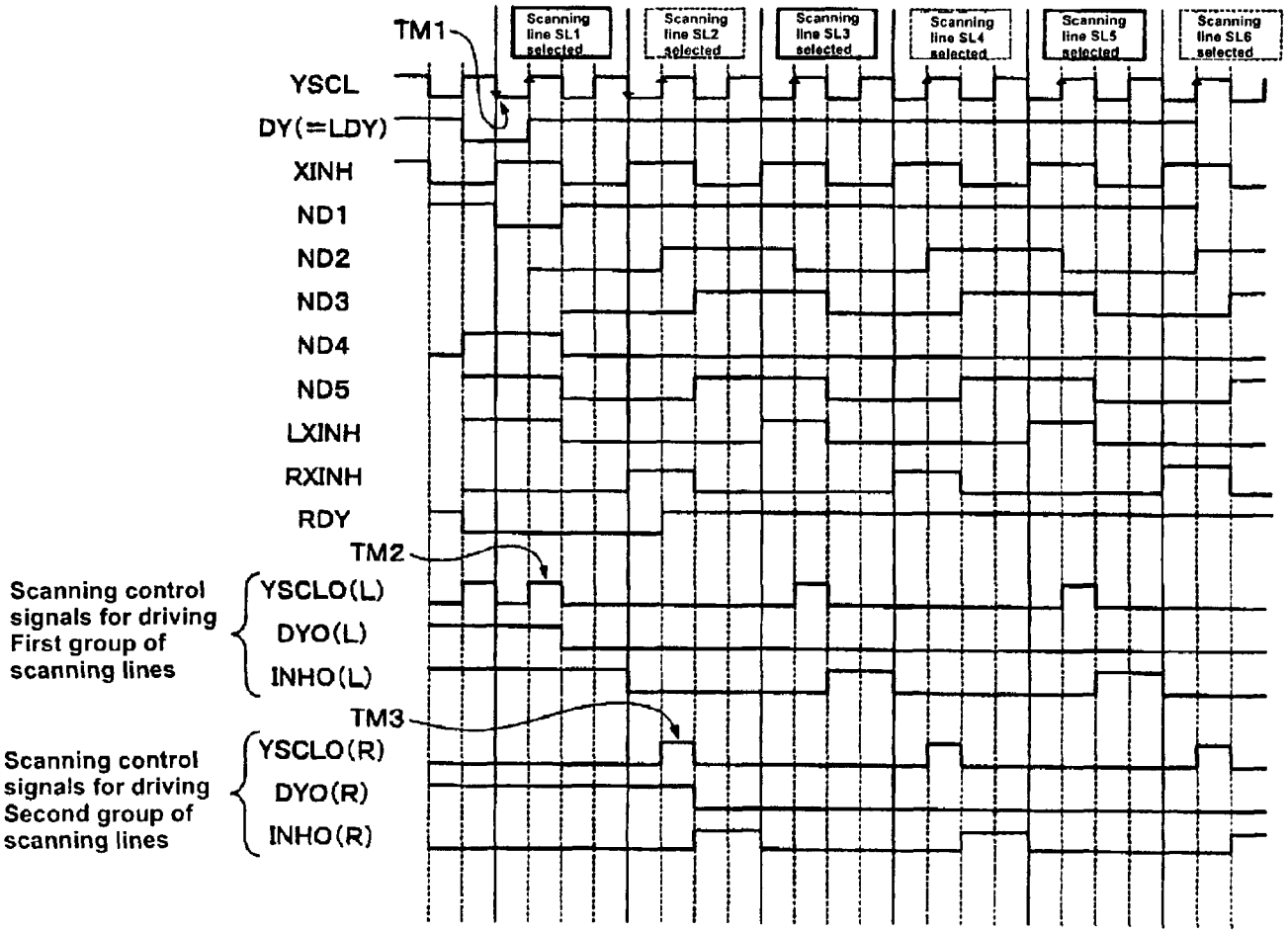
FIG. 12 is a timing chart of an example of an operation of a control circuit in accordance with the aspects of the present invention.

FIG. 12 shows an example of an operation of the control circuit 300. In this example, among YSCLO signals, DYO signals and INHO signals that can be scanning control signals, those of the scanning signals for scan-driving the first group of scanning lines can be defined respectively as YSCLO (L) signal, DYO (L) signal, INHO (L) signal, and those of the scanning control signals for scan-driving the second group of scanning lines can be defined respectively as YSCLO (R) signal, DYO (R) signal and INHO (R) signal.

The control circuit 300 determines that a vertical scanning period starts when DY signal can be at "L" level at a fall of YSCL signal. In FIG. 12, at TM1, and when DY signal can be at "L" level, XINH signal that validates edges of YSCL signal that can be a shift clock can be separated into LXINH signal for the first group of scanning lines and RXINH signal for the second group of scanning lines.

Also, LDY signal for the first group of scanning lines can be generated by delaying DY signal by a delay element. RDY signal for the second group of scanning lines becomes to be a state at "H" level one selection period after LDY signal by RXINH signal that becomes to be "H" level after one selection period.

Then, either the scanning control signals for the first group of scanning lines or those for the second group of scanning lines can be selected in response to POS signal as positional information, to thereby output YSCLO signal, DYO signal and INHO signal.

As a result, at TM2, during a selection period when DYO (L) signal can be at "H" level and YSCLO (L) signal can be outputted, a scanning signal can be outputted to the scanning line $SL_1$. Thereafter, scanning signals can be outputted to the first group of scanning lines every other selection period.

Also, at TM3, during a selection period when DYO (R) signal can be at "H" level and YSCLO (R) signal can be outputted, a scanning signal can be outputted to the scanning line $SL_2$. Thereafter, scanning signals can be outputted to the second group of scanning lines every other selection period.

The first scanning line driver circuit 40 has been described so far, and the same description applies to the second scanning line driver circuit 50. In this manner, the first scanning line driver circuit 40 (the second scanning line driver circuit 50) diverts XINH signal, which controls a thinning-out driving operation that can be conducted to improve the display quality of liquid crystal panels using TFDs. This can generate scanning signals for scan-driving the first group of scanning lines or the second group of scanning lines from display control signals inputted from the data line driver circuit 30 with POS signal as positional information. As a result, the data line driver circuit 30 can supply common display control signals to the first and second scanning line driver circuits 40 and 50 that perform comb teeth driving operations, such that its versatility can be improved without depending on driving methods.

Other Examples

The scanning line driver circuit described above is not restricted or limited to the one shown in FIG. 8. For example, a mode setting device may be provided to switch between the comb teeth driving mode in which lines of the first group and second group of scanning lines can be alternately driven and the normal driving mode in which each of the first group and second group of scanning lines can be successively driven.

A semiconductor device, when the scanning line driver circuit of the modified example can be mounted therein, may be structured to include a terminal for performing a mode setting operation in addition to the terminal for inputting positional information and the terminal for inputting the display control signals described above. In this case, the mode setting operation may be conducted by switching the modes according to logical levels of mode setting signals, or by switching the modes by control commands from the MPU.

Figure 13:
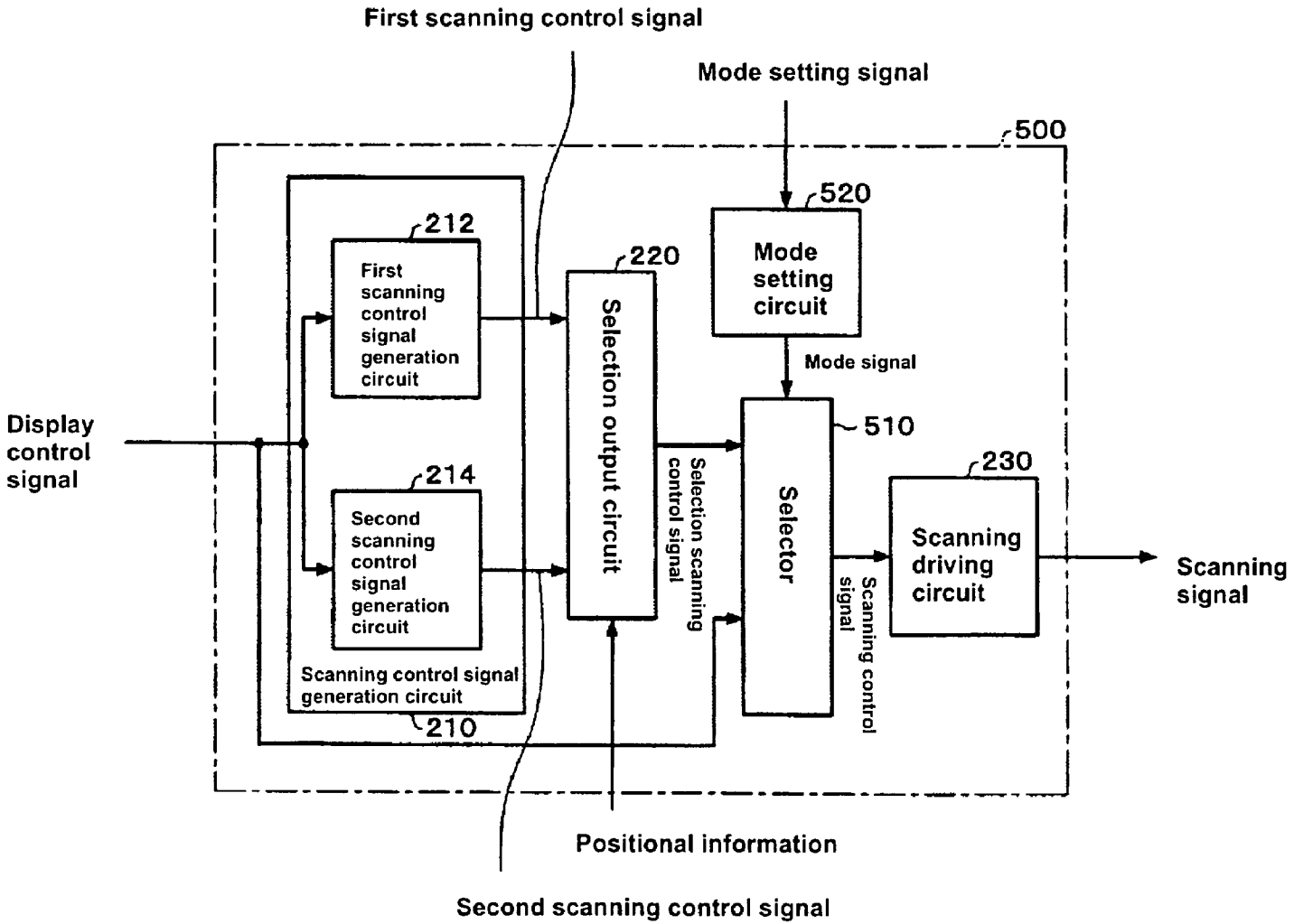
FIG. 13 shows a summary diagram of a structure of a scanning line driver circuit in accordance with a modified example.

FIG. 13 shows a block diagram of a structure of another scanning line driver circuit. It should be noted that the same components as those of the scanning line driver circuit shown in FIG. 8 are indicated by the same reference numbers, and their description can be omitted where appropriate. The scanning line driver circuit of the modified example can be applicable to both of the first and second scanning line driver circuits 40 and 50 described above.

The scanning line driver circuit 500 can include, for example, a scanning control signal generation circuit 210, a selection output circuit 220, a selector 510, a mode setting circuit 520, and a scanning driving circuit 230.

The selection output circuit 220 selects and outputs one of the first and second scanning control signals as a scanning control signal based on positional information inputted from, for example, the data line driver circuit 30.

The selector 510 outputs either a selection scanning control signal provided from the selection output circuit 220 or a display control signal inputted from the data line driver circuit 30 as a scanning control signal based on the mode signal outputted from the mode setting circuit 520.

The mode setting circuit 520 performs a mode setting to set either the normal driving mode or the comb teeth driving mode according to the mode setting signal provided from, for example, the MPU 90. The mode thus set can be outputted to the selector 510 as a selection signal.

The scanning driving circuit 230 generates scanning signals for scan-driving based on the scanning control signal that has been selected and outputted by the selector 510, and supplies the same to the scanning lines.

The scanning line driver circuit 500 described above can be structured to switch by the mode setting operation between the comb teeth driving mode in which the comb teeth driving operation can be conducted through generating scanning signals by one of the first and second scanning control signals generated based on the display control signals according to the positional information, and the normal driving mode in which scanning lines in each of the first group and second group can be successively driven.

In other words, in the comb teeth driving mode, the scanning lines in the first group and second group of scanning lines can be alternately driven, as described above; and in the normal driving mode, the scanning control signal generation circuit described above can be bypassed, and the scanning lines can be successively driven based on the display control signals inputted from the data line driver circuit 30.

In this case, the structure described above can flexibly accommodate scan-driving operations that may be changed according to mounting conditions of the scanning line driver circuit.

Electronic Apparatus

Figure 14:
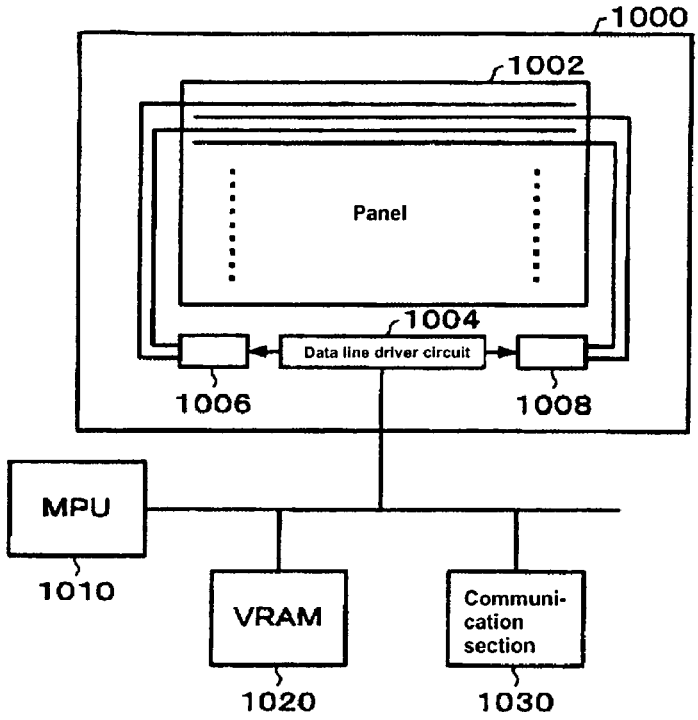
FIG. 14 is a block diagram that shows an example of an electronic apparatus in which an electrooptic apparatus of the aspects of the present invention are applied.

Next, a description will be provided in which the electrooptic apparatus described above can be applied to electronic apparatuses. FIG. 14 shows one example of a block diagram of an electronic apparatus in which the electrooptic apparatus described above can be applied.

An electrooptic apparatus 1000 can be connected to an MPU 1010 through a bus. The bus also connects to a VRAM 1020 and a communication section 1030. The MPU 1020 controls each of the sections through the bus. The VRAM 1020 can include, for example, storage regions having one-to-one correspondences to pixels of a panel 1002 of the electrooptic apparatus 1000, for example, and image data randomly written by the MPU 1010 can be sequentially read out according to the scanning direction.

The communication section 1030 performs various controls to communicate with external devices (for example, a host apparatus and other electronic apparatuses), and its functions can be achieved by a variety of processors, or hardware such as communication ASIC or the like and programs.

In such an electronic apparatus, for example, the MPU 1010 generates various timing signals required to drive the panel 1002 of the electrooptic apparatus 1000, and supplies the same to a data line driver circuit 1004 of the electrooptic apparatus 1000. The data line driver circuit 1004 outputs common display control signals to first and second scanning line driver circuits 1006 and 1008 in which the scanning line driver circuit described above can be applied. The first and second scanning line driver circuits 1006 and 1008 generate scanning signals for driving the first group and second group of scanning lines, respectively, according to the positional information designated by, for example, the MPU 1010, and alternatively drive the scanning lines of the first group and second group of scanning lines.

In accordance with the above, the mounting efficiency of the electrooptic apparatus 1000 can be improved, and the data line driver circuit 1004 can be improved in its versatility without specializing itself for the comb teeth driving control.

Figure 15:
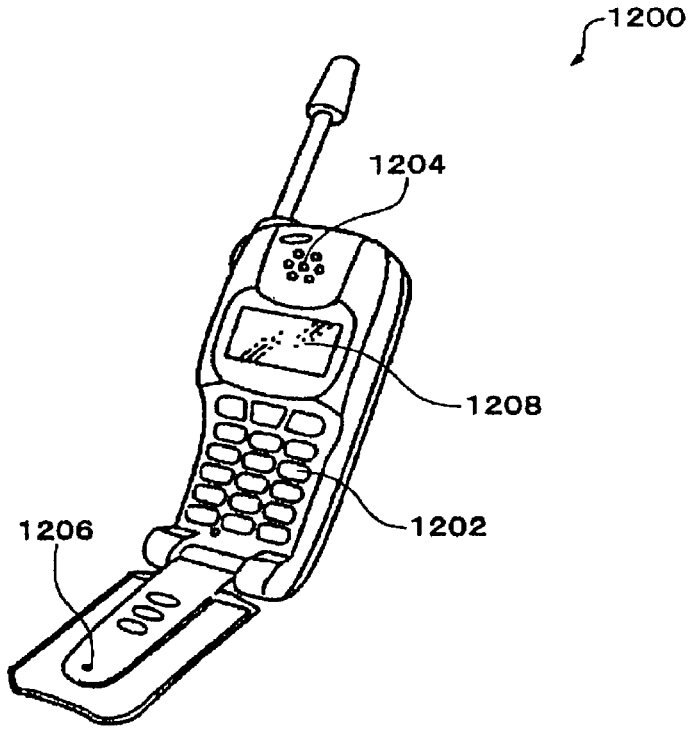
FIG. 15 is a perspective view of a mobile telephone in which an electrooptic apparatus of the aspects of the present invention are applied.

FIG. 15 shows a perspective view of a mobile telephone in which the electrooptic apparatus can be implemented. The mobile telephone 1200 can be equipped with a plurality of operational buttons 1202, a receiver section 1204, a transmitter section 1206, and a panel 1208. A panel that composes the electrooptic apparatus that can be applied to the panel 1208. The panel 1208 displays the strength of magnetic field, numbers, characters and so forth in a standby mode, and the entire region thereof may be used as a display region when a call can be received or transmitted. In this case, the display region may be controlled to lower its power consumption.

While aspects of the present invention have been described in terms of certain preferred aspects, those of ordinary skill in the will appreciate that certain variations, extensions and modifications may be made without varying from the basic teachings of the present invention. As such, aspects of the present invention are not to be limited to the specific preferred embodiments described herein. Rather, the scope of the present invention is to be determined from the claims, which follow this description.

For example, electronic apparatuses and electrooptic apparatuses using the scanning line driver circuits described above can be implemented in all known wireless communicator and wireless computer applications that demand lower power consumption, such as, the mobile telephones described above, as well as, pagers, watches, personal digital assistants (PDAs). Other applicable apparatuses include liquid crystal TVs, video tape recorders in viewfinder types or in monitor direct viewer types, car navigation apparatuses, table-top calculators, word processors, work stations, TV telephones, POS terminals, equipments with touch panels and the like.

Aspects of the present invention described above can be implemented in any situations in which TFDs are used as switching elements for pixels of the liquid crystal panel. However, aspects of the present invention are not necessarily limited to such implementations. For example, thin film transistors (TFTs) can also be used as the switching elements.

Aspects of the present invention described above can be implemented in display apparatuses that use liquid crystal as electrooptic material, however, aspects of the present invention can be also applicable to all apparatuses that use electrooptic effects, such as electroluminescence, fluorescent display tubes, plasma displays, organic EL and the like.

As noted above, aspects of the present invention can also be implemented in any situations in which pixels of a panel and various driver circuits are disposed on a glass substrate. In addition, for example, various driver circuits (the data line driver circuit and scanning line driver circuit described above) may be mounted on a semiconductor device, and the same may be disposed on a common substrate together with a panel having pixel regions.

Some aspects of the present invention described above reference that scanning lines of the first group and second group of scanning lines in comb teeth configurations can be alternately connected to the first and second scanning line driver circuits, respectively. However, aspects of the present invention can be not limited to such embodiments. For example, when gaps of the scanning lines are of no concern, scanning lines in the first group and second group of scanning lines may not be disposed in comb teeth configurations, but may be arranged independently from one another, and the scanning lines in the first group and then the scanning lines in the second group can be successively scan-driven group by group.

What is claimed is:

1. A scanning line driver circuit adapted to drive a first group of scanning lines or a second group of scanning lines of an electrooptic apparatus in which pixels are defined by a plurality of data lines and at least one of the first group of scanning lines or the second group of scanning lines mutually traversing one another, comprising:

a circuit that generates a scanning control signal for driving the first group of scanning lines and the second group of scanning lines from a given display control signal provided from a data line driver circuit that data-drives the plurality of data lines based on given positional information, wherein the first group of scanning lines represents odd numbered scanning lines and the second group of scanning lines represents even numbered scanning lines, wherein the even and odd numbered scanning lines alternately traverse the electrooptic apparatus from opposing first and second ends thereof in a parallel and adjacent manner; and first and second driver circuits that output a scanning signal based on the scanning control signal, wherein the first driver circuit is connected to the odd numbered scanning lines and positioned adjacent to the first end of the electrooptic apparatus and the second driver circuit is connected to the even numbered scanning lines and positioned adjacent to the second end of the electrooptic apparatus.

2. A scanning line driver circuit that drives a first group of scanning lines or a second group of scanning lines of an electrooptic apparatus in which pixels are defined by a plurality of data lines and a first group of scanning lines or a second group of scanning lines mutually traversing one another, comprising:

a first circuit that generates a first scanning control signal for driving the first group of scanning lines based on a given display control signal provided from a data line driver circuit that data-drives the plurality of data lines, wherein the first group of scanning lines represents odd numbered scanning lines;

a second circuit that generates a second scanning control signal for driving the second group of scanning lines based on the given display control signal, wherein the second group of scanning lines represents even numbered scanning lines, and wherein the even and odd numbered scanning lines alternately traverse the electrooptic apparatus from opposing first and second ends thereof in a parallel and adjacent manner;

a selection output circuit that selects and outputs one of the first scanning control signal and the second scanning control signal; and first and second driver circuits that output a scanning signal based on the scanning control signal selected and outputted, wherein the first driver circuit is connected to the odd numbered scanning lines and positioned adjacent to the first end of the electrooptic apparatus and the second driver circuit is connected to the even numbered scanning lines and positioned adjacent to the second end of the electrooptic apparatus.

3. A scanning line driver circuit according to claim 2, wherein the selection output circuit selects and outputs one of the first scanning control signal and the second scanning control signal based on positional information indicative of a position defined with the data line driver circuit as a reference.

4. A scanning line driver circuit according to claim 3, wherein the positional information is supplied by the data line driver circuit.

5. A scanning line driver circuit according to claim 4, wherein the scanning signal is outputted to one of the first group and the second group of scanning lines that are arranged in comb teeth configurations and alternately disposed with one another.

6. A scanning line driver circuit according to claim 5, wherein the given display control signal includes a validation signal that validates edges of the scanning signal for scan-driving, and the driver circuit outputs a driving signal that is validated by the validation signal.

7. A scanning line driver circuit according to claim 6, wherein the plurality of data lines and the first group and the second group of scanning lines are connected to switching elements.

8. A scanning line driver circuit according to claim 7, further comprising:

a circuit that sets one of a comb teeth driving mode that alternately scan-drives lines in the first group and the second group of scanning lines and a normal driving mode that successively drives the first group of scanning lines and the second group of scanning lines, respectively, wherein the driver circuit outputs, when the comb teeth driving mode is set, one of the first scanning signal and the second scanning signal generated based on the first scanning control signal and the second scanning control signal as a scanning signal, and outputs, when the normal driving mode is set, a scanning signal generated based on the given display control signal.

9. An electrooptic apparatus, comprising:

pixels that are defined by a plurality of data lines and a first group of scanning lines or a second group of scanning lines mutually traversing one another, wherein the first group of scanning lines represents odd numbered scanning lines and the second group of scanning lines represents even numbered scanning lines, wherein the even and odd numbered scanning lines alternately traverse the electrooptic apparatus from opposing first and second ends thereof in a parallel and adjacent manner, wherein the plurality of data lines traverse the electrooptic apparatus from a third end thereof perpendicular to the scanning lines;

a first scanning line driver circuit positioned adjacent to the first end of the electrooptic apparatus for scan-driving the first group of scanning lines, wherein the first scanning line driver circuit drives the first group of scanning lines of the electrooptic apparatus in which pixels are defined by a plurality of data lines and the first group of scanning lines mutually traversing one another, comprising: a circuit that generates a first scanning control signal for driving the first group of scanning lines based on a given display control signal provided from a data line driver circuit that data-drives the plurality of data lines;

a second scanning line driver circuit positioned adjacent to the second end of the electrooptic apparatus for scan-driving the second group of scanning lines, wherein the second scanning line driver circuit drives a second group of scanning lines of the electrooptic apparatus in which pixels are defined by a plurality of data lines and the second group of scanning lines mutually traversing one another, comprising: a circuit that generates a first scanning control signal for driving the second group of scanning lines based on a given display control signal provided from a data line driver circuit that data-drives the plurality of data lines;

a selection output circuit that selects and outputs at least one of the first scanning control signal and the second scanning control signal;

a driver circuit that outputs a scanning signal based on the scanning control signal selected and outputted; and a data line driver circuit positioned adjacent to the third end of the electrooptic apparatus that data-drives the plurality of data lines.

10. An electrooptic apparatus according to claim 9, wherein the first scanning line driver circuit for scan-driving the first group of scanning lines, the data line driver circuit, and the second scanning line driver circuit for scan-driving the second group of scanning lines are successively disposed adjacent to a region where the pixels are formed and in an arrangement direction in which the plurality of data lines are arranged.

11. An electrooptic apparatus, comprising:

a panel including pixels that are defined by a plurality of data lines and a first group of scanning lines or a second group of scanning lines mutually traversing one another, wherein the first group of scanning lines represents odd numbered scanning lines and the second group of scanning lines represents even numbered scanning lines, wherein the even and odd numbered scanning lines alternately traverse the electrooptic apparatus from opposing first and second ends thereof in a parallel and adjacent manner, wherein the plurality of data lines traverse the electrooptic apparatus from a third end thereof perpendicular to the scanning lines;

a first scanning line driver circuit positioned adjacent to the first end of the electrooptic apparatus for scan-driving the first group of scanning lines, wherein the first scanning line driver circuit drives the first group of scanning lines of the electrooptic apparatus in which pixels are defined by a plurality of data lines and the first group of scanning lines mutually traversing one another, comprising: a circuit that generates a first scanning control signal for driving the first group of scanning lines based on a given display control signal provided from a data line driver circuit that data-drives the plurality of data lines;

a second scanning line driver circuit positioned adjacent to the second end of the electrooptic apparatus for scan-driving the second group of scanning lines, wherein the second scanning line driver circuit drives a second group of scanning lines of the electrooptic apparatus in which pixels are defined by a plurality of data lines and the second group of scanning lines mutually traversing one another, comprising: a circuit that generates a first scanning control signal for driving the second group of scanning lines based on a given display control signal provided from a data line driver circuit that data-drives the plurality of data lines;

a selection output circuit that selects and outputs one of the first scanning control signal and the second scanning control signal;

a driver circuit that outputs a scanning signal based on the scanning control signal selected and outputted; and a data line driver circuit positioned adjacent to the third end of the electrooptic apparatus that data-drives the plurality of data lines.

12. An electrooptic apparatus according to claim 11, wherein the first scanning line driver circuit for scan-driving the first group of scanning lines, the data line driver circuit, and the second scanning line driver circuit for scan-driving the second group of scanning lines are successively disposed along a first side of the panel in parallel with an arrangement direction in which the plurality of data lines are arranged.

13. An electronic apparatus comprising an electrooptic apparatus comprising:

pixels that are defined by a plurality of data lines and a first group of scanning lines or a second group of scanning lines mutually traversing one another, wherein the first group of scanning lines represents odd numbered scanning lines and the second group of scanning lines represents even numbered scanning lines, wherein the even and odd numbered scanning lines alternately traverse the electrooptic apparatus from opposing first and second ends thereof in a parallel and adjacent manner, wherein the plurality of data lines traverse the electrooptic apparatus from a third end thereof perpendicular to the scanning lines;

a first scanning line driver circuit positioned adjacent to the first end of the electrooptic apparatus for scan-driving the first group of scanning lines, wherein the first scanning line driver circuit drives the first group of scanning lines of the electrooptic apparatus in which pixels are defined by a plurality of data lines and the first group of scanning lines mutually traversing one another, comprising: a circuit that generates a first scanning control signal for driving the first group of scanning lines based on a given display control signal provided from a data line driver circuit that data-drives the plurality of data lines;

a second scanning line driver circuit positioned adjacent to the second end of the electrooptic apparatus for scan-driving the second group of scanning lines, wherein the second scanning line driver circuit drives a second group of scanning lines of the electrooptic apparatus in which pixels are defined by a plurality of data lines and the second group of scanning lines mutually traversing one another, comprising: a circuit that generates a first scanning control signal for driving the second group of scanning lines based on a given display control signal provided from a data line driver circuit that data-drives the plurality of data lines;

a selection output circuit that selects and outputs one of the first scanning control signal and the second scanning control signal;

a driver circuit that outputs a scanning signal based on the scanning control signal selected and outputted; and a data line driver circuit positioned adjacent to the third end of the electrooptic apparatus that data-drives the plurality of data lines.

14. An electronic apparatus according to claim 13, wherein the first scanning line driver circuit for scan-driving the first group of scanning lines, the data line driver circuit, and the second scanning line driver circuit for scan-driving the second group of scanning lines are successively disposed adjacent to a region where the pixels are formed and in an arrangement direction in which the plurality of data lines are arranged.

15. An electronic apparatus comprising an electrooptic apparatus comprising:

a panel including pixels that are defined by a plurality of data lines and a first group of scanning lines or a second group of scanning lines mutually traversing one another, wherein the first group of scanning lines represents odd numbered scanning lines and the second group of scanning lines represents even numbered scanning lines, wherein the even and odd numbered scanning lines alternately traverse the electrooptic apparatus from opposing first and second ends thereof in a parallel and adjacent manner, wherein the plurality of data lines traverse the electrooptic apparatus from a third end thereof perpendicular to the scanning lines;

a first scanning line driver circuit positioned adjacent to the first end of the electrooptic apparatus for scan-driving the first group of scanning lines, wherein the first scanning line driver circuit drives the first group of scanning lines of the electrooptic apparatus in which pixels are defined by a plurality of data lines and the first group of scanning lines mutually traversing one another, comprising: a circuit that generates a first scanning control signal for driving the first group of scanning lines based on a given display control signal provided from a data line driver circuit that data-drives the plurality of data lines;

a second scanning line driver circuit positioned adjacent to the second end of the electrooptic apparatus for scan-driving the second group of scanning lines, wherein the second scanning line driver circuit drives a second group of scanning lines of the electrooptic apparatus in which pixels are defined by a plurality of data lines and the second group of scanning lines mutually traversing one another, comprising: a circuit that generates a first scanning control signal for driving the second group of scanning lines based on a given display control signal provided from a data line driver circuit that data-drives the plurality of data lines;

a selection output circuit that selects and outputs one of the first scanning control signal and the second scanning control signal;

a driver circuit that outputs a scanning signal based on the scanning control signal selected and outputted; and a data line driver circuit positioned adjacent to the third end of the electrooptic apparatus that data-drives the plurality of data lines.

16. An electrooptic apparatus according to claim 11, wherein the first scanning line driver circuit for scan-driving the first group of scanning lines, the data line driver circuit, and the second scanning line driver circuit for scan-driving the second group of scanning lines are successively disposed along a first side of the panel in parallel with an arrangement direction in which the plurality of data lines are arranged.

17. A semiconductor device, comprising:

a scanning line driver circuit that drives a first group of scanning lines or a second group of scanning lines of an electrooptic apparatus in which pixels are defined by a plurality of data lines and a first group of scanning lines or a second group of scanning lines mutually traversing one another, comprising:

a first circuit that generates a first scanning control signal for driving the first group of scanning lines based on a given display control signal provided from a data line driver circuit that data-drives the plurality of data lines, wherein the first group of scanning lines represents odd numbered scanning lines;

a second circuit that generates a second scanning control signal for driving the second group of scanning lines based on the given display control signal, wherein the second group of scanning lines represents even numbered scanning lines, and wherein the even and odd numbered scanning lines alternately traverse the electrooptic apparatus from opposing first and second ends thereof in a parallel and adjacent manner;

a terminal for inputting positional information indicative of a position defined with the data line driver circuit as a reference, wherein the positional information is supplied by the data line driver circuit;

a selection output circuit that selects and outputs one of the first scanning control signal and the second scanning control signal, wherein the selection output circuit selects and outputs one of the first scanning control signal and the second scanning control signal based on the positional information; and first and second driver circuits that output a scanning signal based on the scanning control signal selected and outputted, wherein the first driver circuit is connected to the odd numbered scanning lines and positioned adjacent to the first end of the electrooptic apparatus and the second driver circuit is connected to the even numbered scanning lines and positioned adjacent to the second end of the electrooptic apparatus.

18. A semiconductor device, comprising:

a scanning line driver circuit that drives a first group of scanning lines or a second group of scanning lines of an electrooptic apparatus in which pixels are defined by a plurality of data lines and a first group of scanning lines or a second group of scanning lines mutually traversing one another, comprising:

a circuit that generates a first scanning control signal for driving the first group of scanning lines based on a given display control signal provided from a data line driver circuit that data-drives the plurality of data lines, wherein the given display control signal includes a validation signal that validates edges of the scanning signal for scan-driving, and the driver circuit outputs a driving signal that is validated by the validation signal;

a circuit that generates a second scanning control signal for driving the second group of scanning lines based on the given display control signal;

a terminal for inputting positional information indicative of a position defined with the data line driver circuit as a reference, wherein the positional information is supplied by the data line driver circuit;

a selection output circuit that selects and outputs one of the first scanning control signal and the second scanning control signal, wherein the selection output circuit selects and outputs one of the first scanning control signal and the second scanning control signal based on the positional information; and a driver circuit that outputs a scanning signal based on the scanning control signal selected and outputted, wherein the scanning signal is outputted to one of the first group and the second group of scanning lines that are arranged in comb teeth configurations and alternately disposed with one another.

19. A semiconductor device, comprising:

a scanning line driver circuit that drives a first group of scanning lines or a second group of scanning lines of an electrooptic apparatus in which pixels are defined by a plurality of data lines and a first group of scanning lines or a second group of scanning lines mutually traversing one another, wherein the plurality of data lines and the first group and the second group of scanning lines are connected to switching elements, the scanning line driver circuit comprising:

a circuit that generates a first scanning control signal for driving the first group of scanning lines based on a given display control signal provided from a data line driver circuit that data-drives the plurality of data lines, wherein the given display control signal includes a validation signal that validates edges of the scanning signal for scan-driving, and the driver circuit outputs a driving signal that is validated by the validation signal;

a circuit that generates a second scanning control signal for driving the second group of scanning lines based on the given display control signal;

a terminal for inputting positional information indicative of a position defined with the data line driver circuit as a reference, wherein the positional information is supplied by the data line driver circuit;

a selection output circuit that selects and outputs one of the first scanning control signal and the second scanning control signal, wherein the selection output circuit selects and outputs one of the first scanning control signal and the second scanning control signal based on the positional information; and a driver circuit that outputs a scanning signal based on the scanning control signal selected and outputted, wherein the scanning signal is outputted to one of the first group and the second group of scanning lines that are arranged in comb teeth configurations and alternately disposed with one another; and a circuit that sets one of a comb teeth driving mode that alternately scan-drives lines in the first group and the second group of scanning lines and a normal driving mode that successively drives the first group of scanning lines and the second group of scanning lines, respectively, wherein the driver circuit outputs, when the comb teeth driving mode is set, one of the first scanning signal and the second scanning signal generated based on the first scanning control signal and the second scanning control signal as a scanning signal, and outputs, when the normal driving mode is set, a scanning signal generated based on the given display control signal.

20. A scanning line driver circuit adapted to drive a first group of scanning lines or a second group of scanning lines of an electrooptic apparatus, wherein the first group of scanning lines represents odd numbered scanning lines and the second group of scanning lines represents even numbered scanning lines, wherein the even and odd numbered scanning lines alternately traverse the electrooptic apparatus from opposing first and second ends thereof in a parallel and adjacent manner, comprising:

generating means for generating a scanning control signal based on a given display control signal provided from a data line driver circuit, wherein the data line driver circuit data-drives a plurality of data lines based on given positional information; and first and second driving means for providing a scanning signal based on the scanning control signal, wherein the first driving means is connected to the odd numbered scanning lines and positioned adjacent to the first end of the electrooptic apparatus and the second driving means is connected to the even numbered scanning lines and positioned adjacent to the second end of the electrooptic apparatus.

21. A scanning line driver circuit according to claim 20, wherein the scanning control signal drives at least one of the first group of scanning lines and the second group of scanning lines.

22. A scanning line driver circuit according to claim 20, wherein pixels of the electrooptic apparatus are defined by the plurality of data lines and a first group of scanning lines or a second group of scanning lines mutually traversing one another.

23. A scanning line driver circuit adapted to drive a first group of scanning lines or a second group of scanning lines of an electrooptic apparatus, comprising:

first generating means for generating a first scanning control signal for driving the first group of scanning lines based on a given display control signal provided from a data line driver circuit that data-drives the plurality of data lines, wherein the first group of scanning lines represents odd numbered scanning lines;

second generating means for generating a second scanning control signal for driving the second group of scanning lines based on the given display control signal, wherein the second group of scanning lines represents even numbered scanning lines, and wherein the even and odd numbered scanning lines alternately traverse the electrooptic apparatus from opposing first and second ends thereof in a parallel and adjacent manner, and wherein the given display control signal includes a validation signal that validates edges of the scanning signal for scan-driving, and the data line driver circuit outputs a driving signal that is validated by the validation signal;

selecting means for selecting and providing one of the first scanning control signal and the second scanning control signal; and first and second driving means for providing a scanning signal based on the scanning control signal selected and outputted, wherein the first driving means is connected to the odd numbered scanning lines and positioned adjacent to the first end of the electrooptic apparatus and the second driving means is connected to the even numbered scanning lines and positioned adjacent to the second end of the electrooptic apparatus.

24. A scanning line driver circuit according to claim 23, wherein pixels of the electrooptic apparatus are defined by the plurality of data lines and a first group of scanning lines or a second group of scanning lines mutually traversing one another.

25. A scanning line driver circuit according to claim 23, wherein the selection output circuit selects and outputs one of the first scanning control signal and the second scanning control signal based on positional information supplied by the data line driver circuit, wherein the positional information is indicative of a position defined with the data line driver circuit as a reference.

26. A scanning line driver circuit according to claim 25, wherein the scanning signal is outputted to one of the first group and the second group of scanning lines that are arranged in comb teeth configurations and alternately disposed with one another, further comprising:

a circuit that sets one of a comb teeth driving mode that alternately scan-drives lines in the first group and the second group of scanning lines and a normal driving mode that successively drives the first group of scanning lines and the second group of scanning lines, respectively, wherein the driver circuit outputs, when the comb teeth driving mode is set, one of the first scanning signal and the second scanning signal generated based on the first scanning control signal and the second scanning control signal as a scanning signal, and outputs, when the normal driving mode is set, a scanning signal generated based on the given display control signal.

27. A scanning line driver circuit, comprising:

a first generator unit that generates a first scanning control signal for driving the first group of scanning lines based on a given display control signal provided from a data line driver circuit that data-drives the plurality of data lines, wherein the first group of scanning lines represents odd numbered scanning lines;

a second generator unit that generates a second scanning control signal for driving the second group of scanning lines based on the given display control signal, wherein the second group of scanning lines represents even numbered scanning lines, and wherein the even and odd numbered scanning lines alternately traverse the electrooptic apparatus from opposing first and second ends thereof in a parallel and adjacent manner;

a selection output circuit that selects and outputs one of the first scanning control signal and the second scanning control signal based on positional information supplied by the data line driver circuit, wherein the positional information is indicative of a position defined with the data line driver circuit as a reference; and first and second driver circuits that output a scanning signal based on the scanning control signal selected and outputted, wherein the first driver circuit is connected to the odd numbered scanning lines and positioned adjacent to the first end of the electrooptic apparatus and the second driver circuit is connected to the even numbered scanning lines and positioned adjacent to the second end of the electrooptic apparatus.

28. A scanning line driver circuit according to claim 27, wherein the scanning line driver circuit is adapted to drive at least one of a first group of scanning lines or a second group of scanning lines of an electrooptic apparatus, wherein pixels of the electrooptic apparatus are defined by a plurality of data lines and a first group of scanning lines or a second group of scanning lines mutually traversing one another, and wherein the plurality of data lines and the first group and the second group of scanning lines are connected to switching elements.

* * * * *